US010605033B2

(12) United States Patent
Levert et al.

(10) Patent No.: US 10,605,033 B2
(45) Date of Patent: Mar. 31, 2020

(54) SYSTEMS AND METHODS FOR ASSEMBLING A WELLHEAD

(71) Applicant: CAMERON INTERNATIONAL CORPORATION, Houston, TX (US)

(72) Inventors: Michael Levert, Katy, TX (US); Michael Krejci, Houston, TX (US); Kevin Minnock, Houston, TX (US); Adam Christopherson, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 119 days.

(21) Appl. No.: 15/839,485

(22) Filed: Dec. 12, 2017

(65) Prior Publication Data

US 2018/0163500 A1 Jun. 14, 2018

Related U.S. Application Data

(60) Provisional application No. 62/432,788, filed on Dec. 12, 2016.

(51) Int. Cl.

| | |
|---|---|
| ***E21B 33/04*** | (2006.01) |
| ***E21B 47/09*** | (2012.01) |
| ***E21B 44/02*** | (2006.01) |
| ***E21B 34/02*** | (2006.01) |
| ***E21B 33/03*** | (2006.01) |

(52) U.S. Cl.

CPC ..... *E21B 33/0407* (2013.01); *E21B 33/03* (2013.01); *E21B 33/04* (2013.01); *E21B 33/0415* (2013.01); *E21B 34/02* (2013.01); *E21B 44/02* (2013.01); *E21B 47/09* (2013.01)

(58) Field of Classification Search

CPC ..... E21B 47/09; E21B 33/03; E21B 33/04

See application file for complete search history.

(56) References Cited

U.S. PATENT DOCUMENTS

| | | | | |
|---|---|---|---|---|
| 6,343,654 | B1 | 2/2002 | Brammer | |
| 2002/0189806 | A1* | 12/2002 | Davidson | E21B 33/0355 166/250.01 |
| 2008/0308278 | A1 | 12/2008 | Adamek et al. | |
| 2009/0223674 | A1 | 9/2009 | Christie | |
| 2011/0083854 | A1* | 4/2011 | Jennings | E21B 33/035 166/348 |
| 2012/0085552 | A1 | 4/2012 | Travis et al. | |
| 2015/0275653 | A1* | 10/2015 | Ringgenberg | E21B 33/062 166/336 |
| 2016/0319657 | A1* | 11/2016 | Szpunar | E21B 47/091 |
| 2017/0130577 | A1* | 5/2017 | Cheng | E21B 34/02 |

(Continued)

OTHER PUBLICATIONS

International Search Report and Written Opinion dated May 31, 2018, for Application No. PCT/US2017/065871 (29 pgs).

*Primary Examiner* — Giovanna C Wright
(74) *Attorney, Agent, or Firm* — Conley Rose, P.C.

(57) ABSTRACT

A wellhead system includes a tubing or casing hanger to be installed in a wellhead, the tubing or casing hanger including an outer surface including a landing profile configured to engage a mating landing profile of the wellhead, a landing sensor configured to transmit a signal indicating contact between the landing profile of the tubing or casing hanger and the landing profile of the wellhead, and a processor configured to receive the signal transmitted by the landing sensor.

14 Claims, 20 Drawing Sheets

(56) References Cited

U.S. PATENT DOCUMENTS

| | | | | |
|---|---|---|---|---|
| 2017/0362910 | A1* | 12/2017 | Stephens | E21B 33/143 |
| 2018/0163520 | A1* | 6/2018 | Navar | E21B 43/10 |
| 2019/0169980 | A1* | 6/2019 | Gilleland | E21B 47/0905 |

* cited by examiner

SYSTEMS AND METHODS FOR ASSEMBLING A WELLHEAD

CROSS-REFERENCE TO RELATED APPLICATIONS

The present application claims benefit of U.S. provisional patent application No. 62/432,788 filed Dec. 12, 2016, entitled "Systems and Methods for Assembling a Wellhead" and which is incorporated herein in its entirety.

STATEMENT REGARDING FEDERALLY SPONSORED RESEARCH OR DEVELOPMENT

Not applicable.

BACKGROUND

Hydrocarbon drilling and production systems require various components to access and extract hydrocarbons from subterranean earthen formations. Such systems generally include a wellhead assembly through which the hydrocarbons, such as oil and natural gas, are extracted. The wellhead assembly may include a variety of components, such as valves, fluid conduits, controls, casings, hangers, and the like to control drilling and/or extraction operations. In some operations, hangers, such as tubing or casing hangers, may be used to suspend strings (e.g., piping for various fluid flows into and out of the well) in the well. Such hangers may be disposed or received in a housing, spool, or bowl. In addition to suspending strings inside the wellhead assembly, the hangers provide sealing to seal the interior of the wellhead assembly and strings from pressure inside the wellhead assembly. In some applications, individual hydraulic lines are run from a drilling platform to the wellhead for hydraulically operating specific actuators of a running tool for installing hangers and their associated packoff assemblies, as well as other components. Also, some packoff assemblies and other wellhead components may require torque for proper setting, requiring rotation of the drill string from which the running tool is suspended, which may tangle or damage hydraulic lines or other components of the well system. Further, misalignment between the hanger installed by the running tool and the wellhead or spool in which the hanger is received may necessitate future adjustment prior to the completion of drilling operations.

SUMMARY

An embodiment of a wellhead system comprises a tubing or casing hanger to be installed in a wellhead, the tubing or casing hanger comprising an outer surface including a landing profile configured to engage a mating landing profile of the wellhead, a landing sensor configured to transmit a signal indicating contact between the landing profile of the tubing or casing hanger and the landing profile of the wellhead, and a processor configured to receive the signal transmitted by the landing sensor. In some embodiments, the landing sensor is disposed on the landing profile of the tubing or casing hanger. In some embodiments, the landing sensor is disposed on the landing profile of the wellhead. In certain embodiments, the well system further comprises a plurality of landing sensors disposed on the landing profile of the tubing or casing hanger, each landing sensor configured to transmit a signal indicating contact between the landing profile of the tubing or casing hanger and the landing profile of the wellhead. In certain embodiments, in response to only a portion of the landing sensors transmitting signals indicating contact between the landing profile of the tubing or casing hanger and the landing profile of the wellhead, the processor is configured to transmit a signal indicating an angular misalignment between a longitudinal axis of the tubing or casing hanger and a longitudinal axis of the wellhead. In some embodiments, the landing sensor comprises an electrical switch biased towards the landing profile of the wellhead by a biasing member. In some embodiments, the well system further comprises a plurality of alignment sensors circumferentially spaced about an outer surface of a tool coupled to the tubing or casing hanger, the tool configured to install the tubing or casing hanger in the wellhead, wherein each alignment sensor is configured to transmit a signal indicating a distance between the outer surface of the tool and an inner surface of the wellhead, wherein the processor is configured to receive the signals transmitted by the plurality of alignment sensors.

An embodiment of a wellhead system comprises a tool configured to install a tubing or casing hanger in a wellhead, an alignment sensor configured to transmit a signal indicating a distance between the outer surface of the tool and an inner surface of the wellhead, a processor coupled to the tool and in signal communication with the alignment sensor, the processor configured to receive the signals transmitted by the alignment sensor. In some embodiments, the alignment sensor is disposed on an outer surface of the tool. In some embodiments, the alignment sensor is disposed on an inner surface of the wellhead. In certain embodiments, the well system further comprises a plurality of alignment sensors circumferentially spaced about an outer surface of the tool, each alignment sensor configured to transmit a signal indicating a distance between the outer surface of the tool and the inner surface of the wellhead, wherein the processor the configured to receive the signals transmitted by the plurality of alignment sensors. In certain embodiments, in response to one of the plurality of alignment sensors transmitting a signal indicating a first distance between the outer surface of the tool and the inner surface of the wellhead and another one of the plurality of alignment sensors transmitting a signal indicating a second distance between the outer surface of the tool and the inner surface of the wellhead, where the first distance is different than the second distance, the processor is configured to transmit a signal indicating a radial misalignment between a longitudinal axis of the tubing or casing hanger and a longitudinal axis of the wellhead. In some embodiments, the alignment sensor comprises a contactor biased away from the outer surface of the tool by a first biasing member, and a sensor pin biased into engagement with the contactor by a second biasing member, the sensor pin at least partially disposed in a linear variable differential transformer, wherein the linear variable differential transformer is configured to transmit a signal indicating the position of the sensor pin within the linear variable differential transformer. In some embodiments, the alignment sensor comprises a proximity sensor. In some embodiments, the well system further comprises a plurality of landing sensors disposed on a landing profile of the tubing or casing hanger, each landing sensor configured to transmit a signal indicating contact between the landing profile of the tubing or casing hanger and a landing profile of the wellhead.

An embodiment of a method of assembling a wellhead comprises disposing a tool in the wellhead, the tool configured to install a tubing or casing hanger in the wellhead, measuring a radial distance between an outer surface of the tool and an inner surface of the wellhead using an alignment sensor, and transmitting a signal corresponding to the measured radial distance from the alignment sensor to a processor coupled to the tool. In some embodiments, the method further comprises measuring a plurality of radial distances between the outer surface of the tool and the inner surface of the wellhead using a plurality of alignment sensors spaced circumferentially about the tool, and transmitting a plurality of signals corresponding to the measured radial distances from the alignment sensors to the processor. In some embodiments, the method further comprises transmitting a signal from the processor indicating a radial misalignment between a longitudinal axis of the tubing or casing hanger and a longitudinal axis of the wellhead. In certain embodiments, the method further comprises transmitting a signal indicating contact between a landing profile of the tubing or casing hander and a landing profile of the wellhead to the processor using a landing sensor. In certain embodiments, the method further comprises a signal from the processor indicating an angular misalignment between a longitudinal axis of the tubing or casing hanger and a longitudinal axis of the wellhead.

An embodiment of a wellhead system comprises a tool configured to install a tubing or casing hanger in a wellhead, an electrically controlled valve coupled to the tool, a hydraulic actuator in fluid communication with the electrically controlled valve, the hydraulic actuator configured to manipulate a component of the wellhead system, and a processor coupled to the tool and in signal communication with the electrically controlled valve, wherein the electrically controlled valve is configured to actuate the hydraulic actuator between a first position and a second position in response to a signal communicated to the electrically controlled valve from the processor. In some embodiments, the hydraulic actuator is configured to rotate the tubing or casing hanger. In some embodiments, the hydraulic actuator is configured to apply a torque to a packoff assembly disposed in an annulus extending radially between the tubing or casing hanger and the wellhead, and wherein the packoff assembly is configured to seal the annulus in response to the torque applied by the hydraulic actuator. In certain embodiments, the wellhead system further comprises a fluid pressure source configured to provide fluid pressure to the electrically controlled valve. In certain embodiments, the fluid pressure source comprises pressurized fluid disposed in a bore of a string coupled to the tool, wherein the tool is suspended from the string. In some embodiments, the wellhead system further comprises a piston having a first endface in fluid communication with the fluid pressure source and a second endface sealed from the fluid pressure source, wherein the first endface has a greater surface area than second endface such that a pressure differential is created between the first endface and the second endface while the piston is disposed in static equilibrium. In some embodiments, the wellhead system further comprises a power supply coupled with the processor, and an electrical actuator coupled with the processor and the power supply, the electrical actuator configured to manipulate a component of the wellhead system. In certain embodiments, the electrical actuator is configured to rotate the tubing or casing hanger.

An embodiment of a wellhead system comprises a tool configured to install a tubing or casing hanger in a wellhead, a fluid pressure source configured to transmit fluid pressure to fluid disposed in a passage extending through the tool, a plurality of electrically controlled valves coupled to the tool, each electrically controlled valve of the plurality comprising an inlet port in fluid communication with the passage and a first actuation port in selective fluid communication with the inlet port, a processor coupled to the tool and in signal communication with the plurality of electrically controlled valves, wherein the processor is configured to actuate at least one of the electrically controlled valves between a first position, where fluid communication is restricted between the inlet port and the first actuation port, and a second position, where fluid communication is provided between the inlet port and the first actuation port. In some embodiments, the fluid pressure source comprises pressurized fluid disposed in a bore of a string coupled to the tool, wherein the tool is suspended from the string. In some embodiments, the wellhead system further comprises a plurality of hydraulic actuators, each hydraulic actuator in fluid communication with an electrically controlled valve, wherein each hydraulic actuator is configured to manipulate a component of the wellhead system. In certain embodiments, at least one of the plurality of hydraulic actuators is configured to manipulate a component of the wellhead system in response to at least one of the electrically controlled valves being actuated from the first position to the second position by the processor. In certain embodiments, at least one of the plurality of hydraulic actuators is configured to rotate the tubing or casing hanger in response to at least one of the electrically controlled valves being actuated from the first position to the second position by the processor. In some embodiments, at least one of the plurality of hydraulic actuators is configured to apply a torque to a packoff assembly of the wellhead system in response to at least one of the electrically controlled valves being actuated from the first position to the second position by the processor. In some embodiments, each electrically controlled valve of the plurality further comprises a second actuation port, and wherein the processor is configured to actuate at least one of the electrically controlled valves between the first position, where fluid communication is restricted between the inlet port and the second actuation port, and a third position where fluid communication is provided between the inlet port and the second actuation port. In some embodiments, at least one of the electrically controlled valves comprises a vent port, and wherein, when the valve is disposed in the second position, the vent port is in fluid communication with the second actuation port, and when the valve is disposed in the third position, the vent port is in fluid communication with the first actuation port.

An embodiment of a method of assembling a wellhead comprises disposing a tool in the wellhead, the tool configured to install a tubing or casing hanger in the wellhead, transmitting a signal from a processor to an electrically controlled valve coupled to the tool to actuate the valve from a first position to a second position, and actuating a hydraulic actuator to manipulate a component of the wellhead in response to actuating the valve from the first position to the second position. In some embodiments, the method further comprises actuating the hydraulic actuator to rotate the tubing or casing hanger in response to actuating the valve from the first position to the second position. In some embodiments, the method further comprises providing pressurized fluid from a bore extending through a string from which the tool is suspended to a plurality of electrically controlled valves coupled to the tool. In certain embodiments, the method further comprises transmitting a signal from the processor to an electrical actuator to rotate the tubing or casing hanger.

An embodiment of a wellhead system comprises a tool configured to install a tubing or casing hanger in a wellhead, a fluid pressure source configured to transmit fluid pressure to fluid disposed in a passage extending through the tool, and a hydraulic actuator comprising an inlet in fluid communication with the passage disposed in the tool, and an engagement member, wherein, in response to the application of fluid pressure to the inlet of the hydraulic actuator, the hydraulic actuator is configured to apply a torque to the component of the wellhead system via engagement between the engagement member and the component. In some embodiments, the fluid pressure source comprises pressurized fluid disposed in a bore of a string coupled to the tool, wherein the tool is suspended from the string. In some embodiments, the component of the wellhead system comprises a tubing or casing hanger. In certain embodiments, the component of the wellhead system comprises a packoff assembly. In certain embodiments, the component of the wellhead system comprises a torque sleeve rotationally coupled to the tool. In some embodiments, the hydraulic actuator comprises a hydraulic motor in fluid communication with the passage, and the engagement member comprises a gear coupled to the hydraulic motor and configured to receive a torque provided by the hydraulic motor in response to the inlet of pressurized fluid to the hydraulic motor from the passage. In certain embodiments, the wellhead system further comprises a rotational member in engagement with the gear and coupled to the tubing or casing hanger, the rotational member configured to receive the torque provided by the gear to rotate the tubing or casing hanger. In certain embodiments, the hydraulic actuator comprises an annular actuation member disposed in an annular recess extending in the tool, the actuation member comprising a helical groove extending into a surface thereof, the engagement member is coupled to the tubing or casing hanger and comprises an annular rotational member comprising a helical groove extending into a surface of the rotational member, and a ball bearing disposed in both the helical groove of the actuation member and the helical groove of the rotational member, and in response to a pressure applied to an endface of the actuation member, the actuation member is configured to apply a torque to the rotational member to rotate the tubing or casing hanger via interlocking engagement provided by the ball bearing between the actuation member and the rotational member. In some embodiments, the hydraulic actuator comprises a chamber including an inlet port and an outlet port, where the inlet and outlet ports of the chamber are in fluid communication with the passage, the engagement member comprises a shaft extending through the chamber, the shaft comprising a plurality of radially extending vanes, and in response to the flow of pressurized fluid into the inlet port of the chamber, a torque is applied to the shaft via engagement between the vanes and the pressurized fluid flowing through the chamber. In some embodiments, the hydraulic actuator comprises a chamber including an inlet port and an outlet port, where the inlet and outlet ports of the chamber are in fluid communication with the passage, the engagement member comprises a first shaft and a second shaft, where each shaft extends through the chamber and comprises a plurality of teeth disposed on an outer surface of the shaft, the teeth of the first shaft and the teeth of the second shaft are in mating engagement, and in response to the flow of pressurized fluid into the inlet port of the chamber, a torque is applied to the first shaft via engagement between the teeth of the first shaft and the pressurized fluid flowing through the chamber. In certain embodiments, the hydraulic actuator comprises a first piston received in a first cylinder, wherein the first piston is displaceable through the first cylinder in response to the application of a fluid pressure to an inlet port of the first cylinder in fluid communication with the passage, and a first ratchet member coupled to the first piston and including a tooth disposed on a surface of the ratchet member, the engagement member comprises an outer surface including a plurality of teeth configured to matingly engage the tooth of the first ratchet member, and in response to displacement of the first piston through the first cylinder, the first ratchet member is configured to apply a torque in a first rotational direction to the engagement member via engagement between the tooth of the first ratchet member and the teeth of the engagement member. In certain embodiments, the hydraulic actuator further comprises a second piston received in a second cylinder, wherein the second piston is displaceable through the second cylinder in response to the application of a fluid pressure to an inlet port of the second cylinder in fluid communication with the passage, and a second ratchet member coupled to the second piston and including a tooth disposed on a surface of the ratchet member, wherein in response to displacement of the second piston through the second cylinder, the second ratchet member is configured to apply a torque in a second rotational direction, opposite the first rotational direction, to the engagement member via engagement between the tooth of the second ratchet member and the teeth of the engagement member. In some embodiments, the first ratchet member comprises a first position where the first ratchet member is disposed distal the engagement member, the first ratchet member comprises a second position where the tooth of the first ratchet member is in engagement with the teeth of the engagement member, and the first ratchet member is displaceable between the first position and the second position in response to the application of a pressurized fluid to the inlet port of the first cylinder.

An embodiment of a method of assembling a wellhead comprises disposing a tool in the wellhead, the tool configured to install a tubing or casing hanger in the wellhead, supplying a hydraulic actuator coupled to the tool with fluid pressurized by a fluid pressure source, and actuating the hydraulic actuator in response to receiving pressurized fluid to apply a torque to a component of the wellhead. In some embodiments, the method further comprises supplying the hydraulic actuator with pressurized fluid disposed in a bore of a string coupled to the tool, wherein the tool is suspended from the string. In some embodiments, the method further comprises actuating the hydraulic actuator to rotate the tubing or casing hanger. In certain embodiments, the method further comprises actuating the hydraulic actuator to apply a torque to a packoff assembly. In certain embodiments, the method further comprises actuating the hydraulic actuator to apply a torque to a torque sleeve rotationally coupled to the tool. In some embodiments, actuating the hydraulic actuator comprises rotating a gear coupled to a hydraulic motor. In some embodiments, actuating the hydraulic actuator comprises actuating a ratcheting member to apply a torque to an engagement member via engagement between a tooth of the ratcheting member and a plurality of teeth of the engagement member.

BRIEF DESCRIPTION OF THE DRAWINGS

For a detailed description of exemplary embodiments, reference will now be made to the accompanying drawings in which.

DETAILED DESCRIPTION

Figure 1:
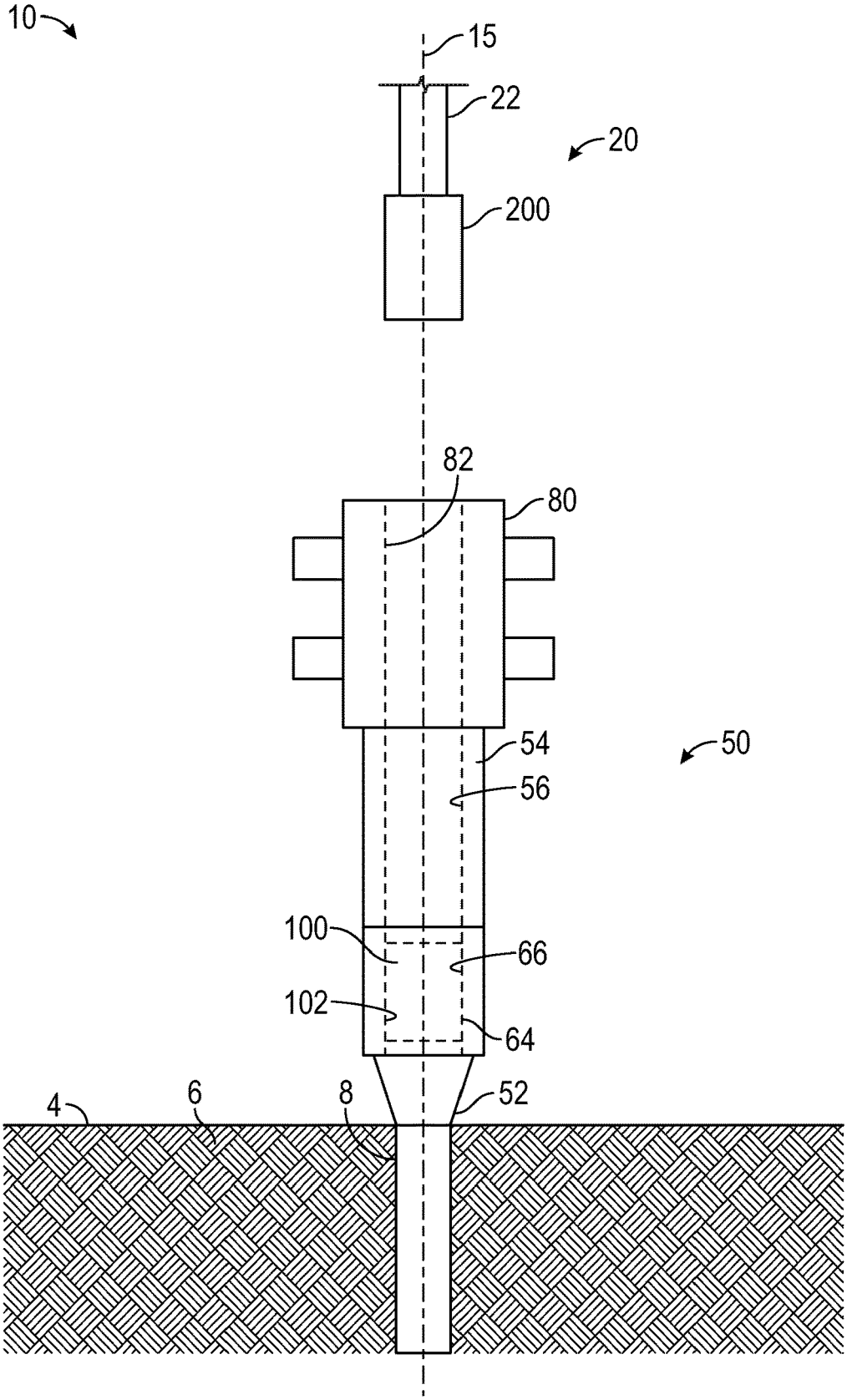
FIG. 1 is a schematic view of an embodiment of a well system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 is a schematic diagram showing an embodiment of a well or wellhead system 10 having a central or longitudinal axis 15. The well system 10 can be configured to extract various minerals and natural resources, including hydrocarbons (e.g., oil and/or natural gas), or configured to inject substances into an earthen surface 4 and an earthen formation 6 via a well or wellbore 8. In some embodiments, the well system 10 is land-based, such that the surface 4 is land surface, or subsea, such that the surface 4 is the seal floor. The system 10 includes a wellhead 50 that can receive a tool or tubular string conveyance 20. The wellhead 50 is coupled to a wellbore 8 via a wellhead connector or hub 52. The wellhead 50 typically includes multiple components that control and regulate activities and conditions associated with the wellbore 8. For example, the wellhead 50 generally includes bodies, valves and seals that route produced fluids from the wellbore 8, provide for regulating pressure in the wellbore 8, and provide for the injection of substances or chemicals downhole into the wellbore 8.

In the embodiment shown, the wellhead 50 includes a Christmas tree or tree 54, a tubing and/or casing spool or housing 64, and a tubing and/or casing hanger 100. For ease of description below, reference to "tubing" shall include casing and other tubulars associated with wellheads. Further, "spool" may also be referred to as "housing," "receptacle," or "bowl." A blowout preventer (BOP) 80 may also be included, either as a part of the tree 54 or as a separate device. The BOP 80 may include a variety of valves, fittings, and controls to prevent oil, gas, or other fluid from exiting the wellbore 8 in the event of an unintentional release of pressure or an overpressure condition. The system 10 may include other devices that are coupled to the wellhead 50, and devices that are used to assemble and control various components of the wellhead 50. For example, in the illustrated embodiment, the system 10 includes tool conveyance 20 including a tool 200 suspended from a tool or string 22. In certain embodiments, tool 200 comprises a running tool that is lowered (e.g., run) from an offshore vessel (not shown) to the wellbore 8 and/or the wellhead 50. In this embodiment, string 22 may comprise a drill string lowered from the offshore vessel. In other embodiments, such as land surface systems, tool 200 may include a device suspended over and/or lowered into the wellhead 50 via a crane or other supporting device.

The tree 54 generally includes a variety of flow paths, bores, valves, fittings, and controls for operating the wellbore 8. The tree 54 may provide fluid communication with the wellbore 8. For example, the tree 54 includes a tree bore 56. The tree bore 56 provides for completion and workover procedures, such as the insertion of tools into the wellbore 8, the injection of various substances into the wellbore 8, and the like. Further, fluids extracted from the wellbore 8, such as oil and natural gas, may be regulated and routed via the tree 54. As is shown in the system 10, the tree bore 56 may fluidly couple and communicate with a BOP bore 82 of the BOP 80.

The spool 64 provides a base for the tree 54. The spool 64 includes a spool bore 66. The spool bore 66 fluidly couples to enable fluid communication between the tree bore 56 and the wellbore 8. Thus, the bores 82, 56, and 66 may provide access to the wellbore 8 for various completion and workover procedures. For example, components can be run down to the wellhead 50 and disposed in the spool bore 66 to seal off the wellbore 8, to inject fluids downhole, to suspend tools downhole, to retrieve tools downhole, and the like. For instance, casing and/or tubing hangers may be installed within spool 64 via the access provided by bores 82, 56, and 66. In some embodiments, the casing and/or tubing hangers are conveyed to the wellhead 50 via tool conveyance 20 for installation within spool bore 64. In certain embodiments, associated components of the casing and/or tubing hangers, such as seal or packoff assemblies, are installed within spool bore 66 via tool 200 of conveyance tool 20. As will be described further herein, in some embodiments the tool 200 is configured to install hanger 100 and accessary components thereof within spool 64.

As one of ordinary skill in the art understands, the wellbore 8 may contain elevated pressures. For example, the wellbore 8 may include pressures that exceed 10,000 pounds per square inch (PSI). Accordingly, well system 10 employs various mechanisms, such as mandrels, seals, plugs and valves, to control and regulate the well 8. For example, the hanger 100 is typically disposed within the wellhead 50 to secure tubing and casing suspended in the wellbore 8, and to provide a path for hydraulic control fluid, chemical injections, and the like. The hanger 100 includes a hanger bore 102 that extends through the center of the hanger 100, and that is in fluid communication with the spool bore 66 and the wellbore 8.

Figure 2A:
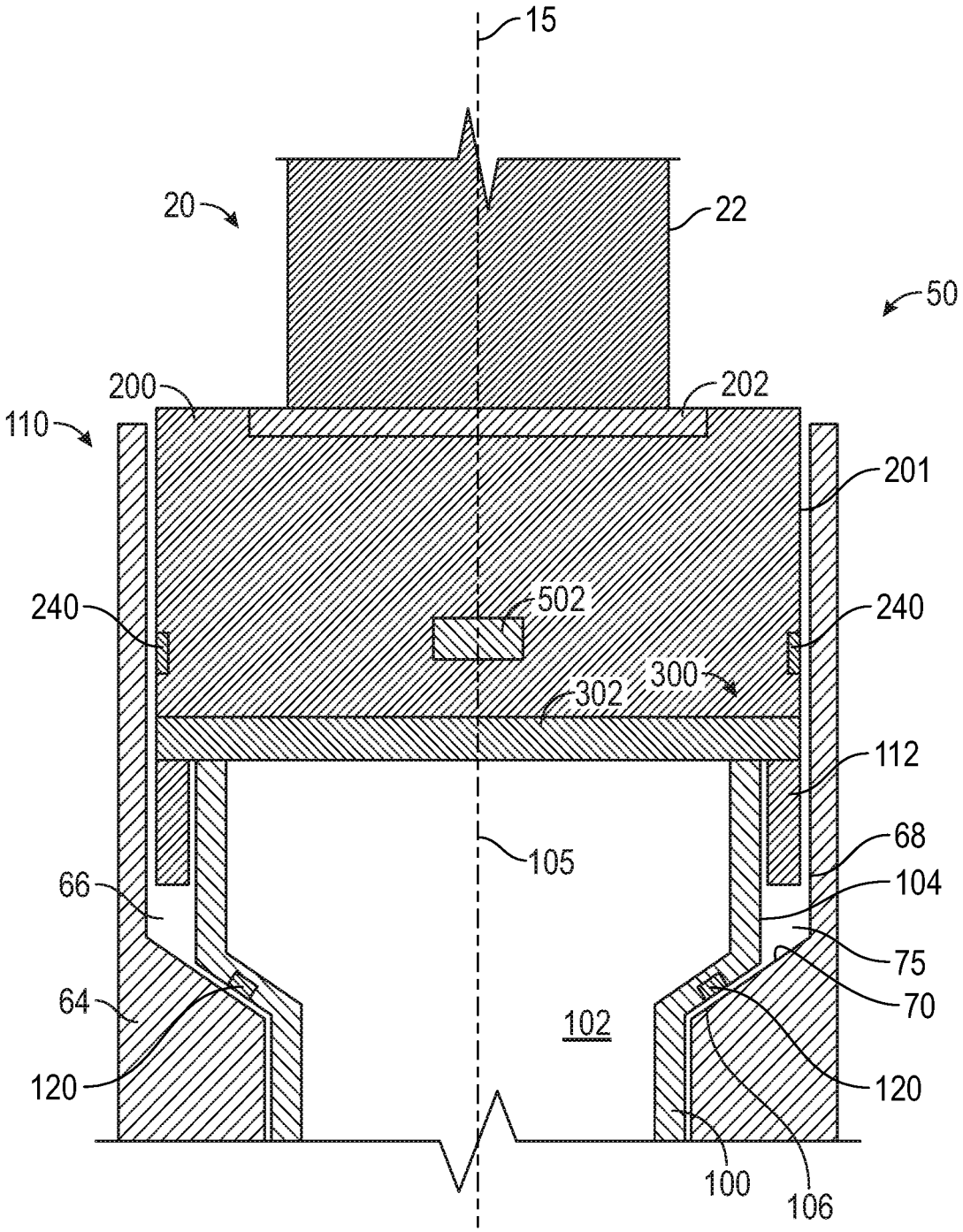
FIG. 2A is a schematic, partial cross-sectional view of an embodiment of a wellhead assembly system of the well system of FIG. 1 in accordance with principles disclosed herein.

Referring to FIG. 2A, a schematic cross-sectional view of a wellhead assembly system 110 of the well system 10 of FIG. 1 is shown, where wellhead assembly system 110 generally includes tool conveyance 20, spool 64, hanger 100, and an annular packoff or seal assembly 112. Particularly, FIG. 2 schematically illustrates tool conveyance 20, spool 64, hanger 100, and packoff assembly 112 in partial cross-section. Thus, components 20, 64, 100, and 112 may include additional components not explicitly shown in FIG. 2. In the embodiment shown in FIG. 2, the bore 66 of spool 64 is defined by a generally cylindrical inner surface 68 including an annular landing profile 70 extending radially inwards towards longitudinal axis 15. In the embodiment shown, hanger 100 has a central or longitudinal axis 105 (shown coaxial with axis 15 in FIG. 2) and includes a generally cylindrical outer surface 104 including a radially outwards extending landing profile 106 disposed at an angle relative longitudinal axis 105.

In this arrangement, an annulus 75 is formed between the inner surface 68 of spool 64 and the outer surface 104 of hanger 100. The landing profile 70 of spool 64 is configured to matingly engage the landing profile 106 of hanger 100 to physically support hanger 100 within the bore 66 of spool 64 upon installation of hanger 100 in wellhead 50. In some applications, hanger 100 is conveyed into bore 66 of spool 64 by conveyance tool 20 until landing profile 106 of hanger 100 physically engages the landing profile 70 of spool 64, thereby arresting the downward displacement (relative surface 4) of hanger 100 through bore 66 of spool 64.

In the embodiment shown in FIG. 2, tool 200 comprises a running tool configured to install hanger 100 and packoff assembly 112 within spool 64, whether in offshore or land-based applications. Particularly, tool 200 is configured to seat hanger 100 within spool 64 such that longitudinal axis 105 of hanger 100 is disposed substantially coaxial with the longitudinal axis of spool 64, which is disposed coaxial with axis 15. In certain embodiments, tool 200 is configured to rotate hanger 100 within spool 64 to install hanger 100 therein. Tool 200 is further configured to install and set/energize packoff assembly 112 within spool 64 such that packoff assembly 112 seals the annulus 75 extending between the hanger 100 and spool 64. In the embodiment shown, packoff assembly 112 requires rotational torque (i.e., about longitudinal axis 105) applied thereto to be set and/or locked into position within annulus 75; however, in other embodiments, wellhead assembly system 110 may include a packoff that is not set or energized via the application of a rotational torque. Moreover, wellhead assembly system 110 may include other hangers, packoff assemblies, and additional components not shown in FIG. 2.

In the embodiment shown, hanger 100 includes a plurality of circumferentially spaced landing sensors 120 disposed along the landing profile 106 of outer surface 104 and configured to detect the landing of hanger 100 within spool 64 as well as angular misalignment (i.e., where a first axis is disposed at an angle in relation to a second axis) between longitudinal axis 105 of hanger 100 and longitudinal axis 15, which is disposed coaxial with the longitudinal axis of spool 64. In the embodiment shown, tool 200 includes a generally cylindrical outer surface 201, a pressure intensifier 202 configured to increase the fluid pressure, including the hydrostatic pressure, of fluid provided to tool 200 by string 22. Also in the embodiment shown, tool 200 comprises a plurality of circumferentially spaced alignment sensors 240, a torque application assembly 300, and an electronic control module (ECM) or processor 502 in signal communication with alignment sensors 240 and the landing sensors 120 of hanger 100.

Alignment sensors 240 of tool 200 are configured to detect radial misalignment 245 (i.e., where a first axis is radially spaced relative a second axis) between longitudinal axis 105 of hanger 100 and the longitudinal axis of spool 64 (i.e., longitudinal axis 15) as hanger 100 and/or packoff assembly 112 are installed within spool 64. ECM 502 is configured to communicate with sensors 120, 240, and other components of wellhead assembly system 110 to form an actuation and control system 500 (shown in FIG. 15), as will be described further herein. Torque application assembly 300 is configured to translate hydraulic pressure or fluid flow provided by string 22 into a torque to be applied against rotationally or "torque-set" components of wellhead 50, such as packoff assembly 112. In the embodiment shown, torque application assembly 300 is configured translate the supplied fluid pressure into a torque against a torque sleeve or rotational/engagement member 302 rotationally coupled to tool 200, which is permitted to rotate relative string 22 in response to an application of a torque thereto via the torque application assembly 300. While in this embodiment torque application assembly 300 is included in tool 200, in other embodiments of wellhead assembly system 110, torque application assembly 300 may be included directly into the component (e.g., hangers, packoffs, and other components) of wellhead assembly system 110 requiring torque for installation. In this arrangement, tool 200 may supply the hydraulic pressure or flow to the component including the torque application assembly 300 for translating the supplied pressure or flow into torque.

Figure 2B:
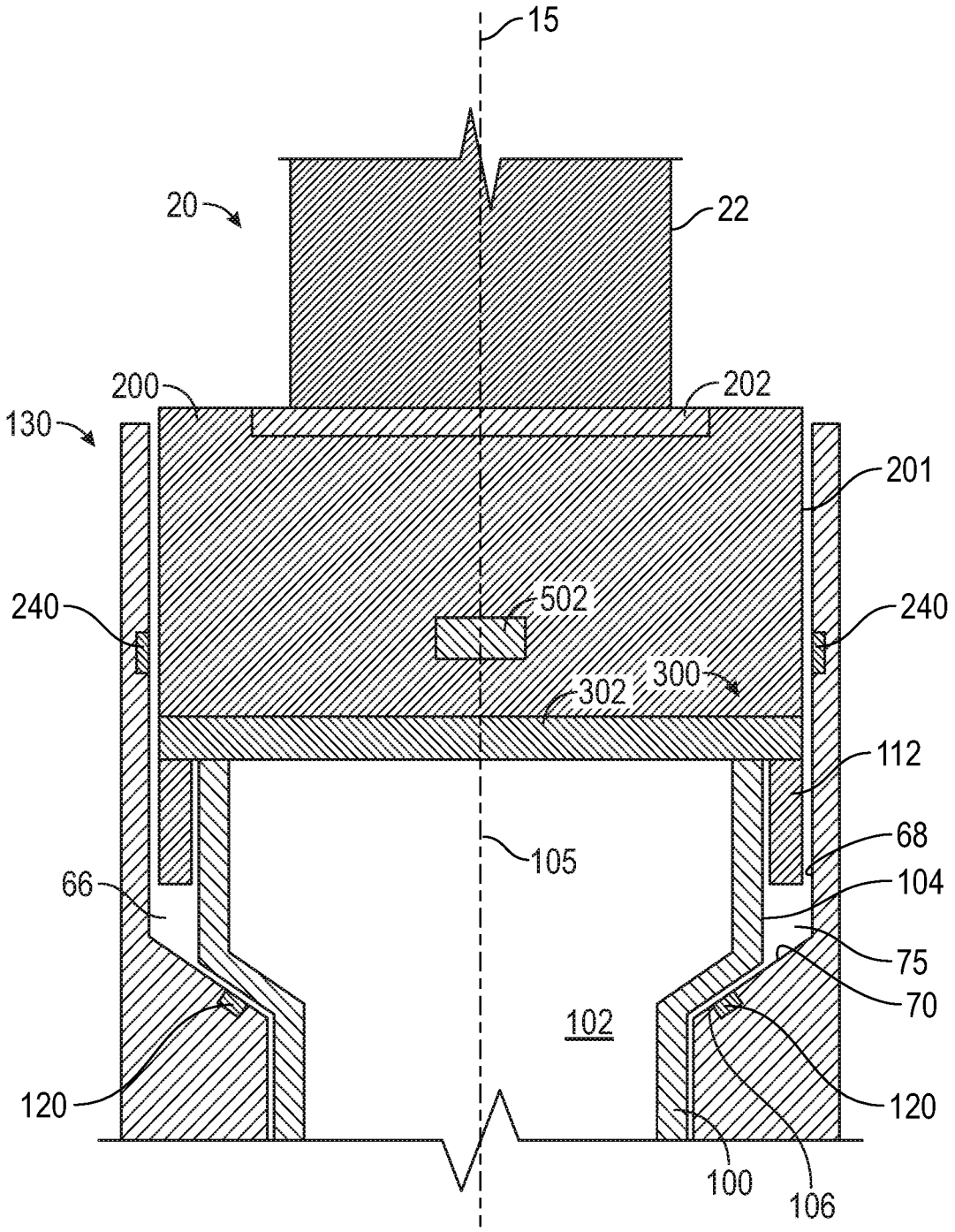
FIG. 2B is a schematic, partial cross-sectional view of another embodiment of a wellhead assembly system of the well system of FIG. 1 in accordance with principles disclosed herein.

Referring briefly to FIG. 2B, a schematic cross-sectional view of another embodiment of a wellhead assembly system 130 of the well system 10 of FIG. 1 is shown. Wellhead assembly system 130 includes features in common with wellhead assembly system 110 shown in FIG. 2A, and shared components are similarly labeled. In the embodiment shown, alignment sensors 240 are circumferentially spaced about the inner surface 68 of spool 64 instead of being disposed on the outer surface 201 of tool 200. Also, landing sensors 120 are circumferentially spaced about the landing profile 70 of spool 64 instead of being disposed on the landing profile 106 of hanger 100. Although sensors 240 and 120 are each disposed on the inner surface 68 of spool 64, sensors 240 and 120 are configured to function in a similar manner as described above with respect to wellhead assembly system 110 shown in FIG. 2A.

Figure 3:
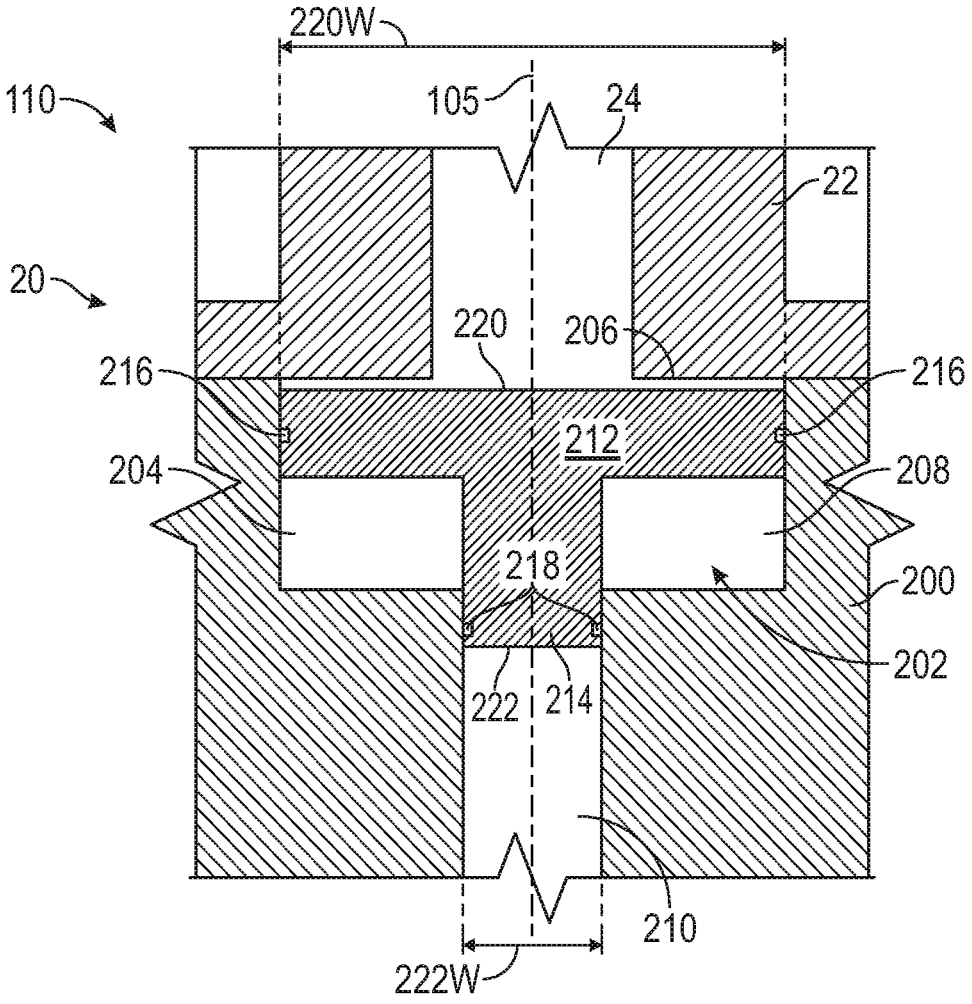
FIG. 3 is a schematic cross-sectional view of an embodiment of a pressure intensifier of the wellhead assembly system of FIG. 2A in accordance with principles disclosed herein.

Referring to FIGS. 2 and 3, an embodiment of the pressure intensifier 202 of FIG. 2A is shown schematically in cross-section in FIG. 3. In the embodiment shown, pressure intensifier 202 of tool 200 generally includes a cylinder or chamber 204, a fluid passage 210 in fluid communication with cylinder 204, and a piston 212 disposed within cylinder 204. Piston 212 includes an annular seal 216 in sealing engagement with an inner surface of cylinder 204 and a piston rod or extension 214 extending axially from piston 212 and received within passage 210, where piston extension 214 includes an annular seal 218 in sealing engagement with an inner surface of passage 210. In this arrangement, the sealing engagement provided by seal 216 of piston 212 divides cylinder 204 into a first or upper chamber 206 and a second or lower chamber 208, where fluid communication is restricted between chambers 206 and 208. In addition, the sealing engagement provided by seal 218 of piston extension 214 restricts fluid communication between passage 210 and cylinder 204.

As shown in FIG. 3, in this embodiment the upper chamber 206 of cylinder 204 is in fluid communication with, and receives hydraulic pressure from, a central bore 24 of string 22. Fluid pressure from upper chamber 206 is applied against an upper endface 220 of piston 212 while fluid disposed within passage 210 receives pressure from a lower endface 222 of piston extension 214. In certain embodiments, fluid within bore 24 is pressurized by pumps disposed at a surface drilling platform or rig from which string 22 extends. Passage 210 is in fluid communication with torque application assembly 300, as well as other hydraulically actuated components of wellhead assembly system 110, for providing pressurized hydraulic fluid for powering or actuating these hydraulically actuated components.

In this embodiment fluid pressure within lower chamber 208 is reduced with respect to the fluid disposed in bore 24 and passage 210 to enhance the pressure intensification provided by pressure intensifier 202. The upper endface 220 of piston 212 includes a width or surface area 220*w* that is greater in size than a width or surface area 222*w* of the lower endface 222 of piston extension 214. In this embodiment, bore 24 and passage 210 are filled with substantially incompressible fluid, thereby restricting movement of piston 212 within cylinder 216 and placing piston 212 into static equilibrium. In this arrangement, static equilibrium of piston 212 within cylinder 216 requires substantially equal forces to be applied against endfaces 220 and 222 of piston 212, where the force applied against each endface 220 and 222 corresponds to the degree of fluid pressure communicated to endfaces 220 and 222 multiplied by the surface area 220*w* and 222*w* of endfaces 220 and 222, respectively.

Given that upper endface 220 has a greater surface area 220*w* than lower endface 222*w*, the degree of fluid pressure communicated between the fluid in upper chamber 206 (disposed at substantially the same pressure as fluid in bore 24) and upper endface 220 must be less than the degree of fluid pressure communicated between fluid in passage 210 and lower endface 222 to maintain static equilibrium of piston 212. Therefore, the relative greater surface area 220*w* of upper endface 220 results in a relative greater degree of pressure communicated from lower endface 222 to the fluid disposed in passage 210, resulting in a higher fluid pressure within passage 210 than in either upper chamber 206 or bore 24. In other words, the greater surface area 220*w* of upper endface 220 than the surface area 222*w* of lower endface 222 magnifies or intensifies the fluid pressure communicated between bore 24 and fluid passage 210 of tool 200. The increased or intensified fluid pressure disposed in passage 210 may be utilized by torque application assembly 300 and other hydraulically actuated components of wellhead system 110 for their actuation. In this manner, the fluid pressure supplied by bore 24 of string 22 may be maximized or more efficiently utilized to power hydraulically actuated components of wellhead assembly system 110, mitigating the need for independently pressurized fluid conduits run from a surface platform or other pressure sources, such as accumulators coupled to wellhead 50. Thus, intensification of fluid pressure within bore 24 of string 22 may eliminate additional hydraulic equipment for operating the hydraulically actuated components of wellhead assembly system 110. Although passage 210 is shown in FIG. 3 sealed from bore 24 of string 22, in other embodiments, passage 210 is in fluid communication with bore 24 of string 22.

Figure 4:
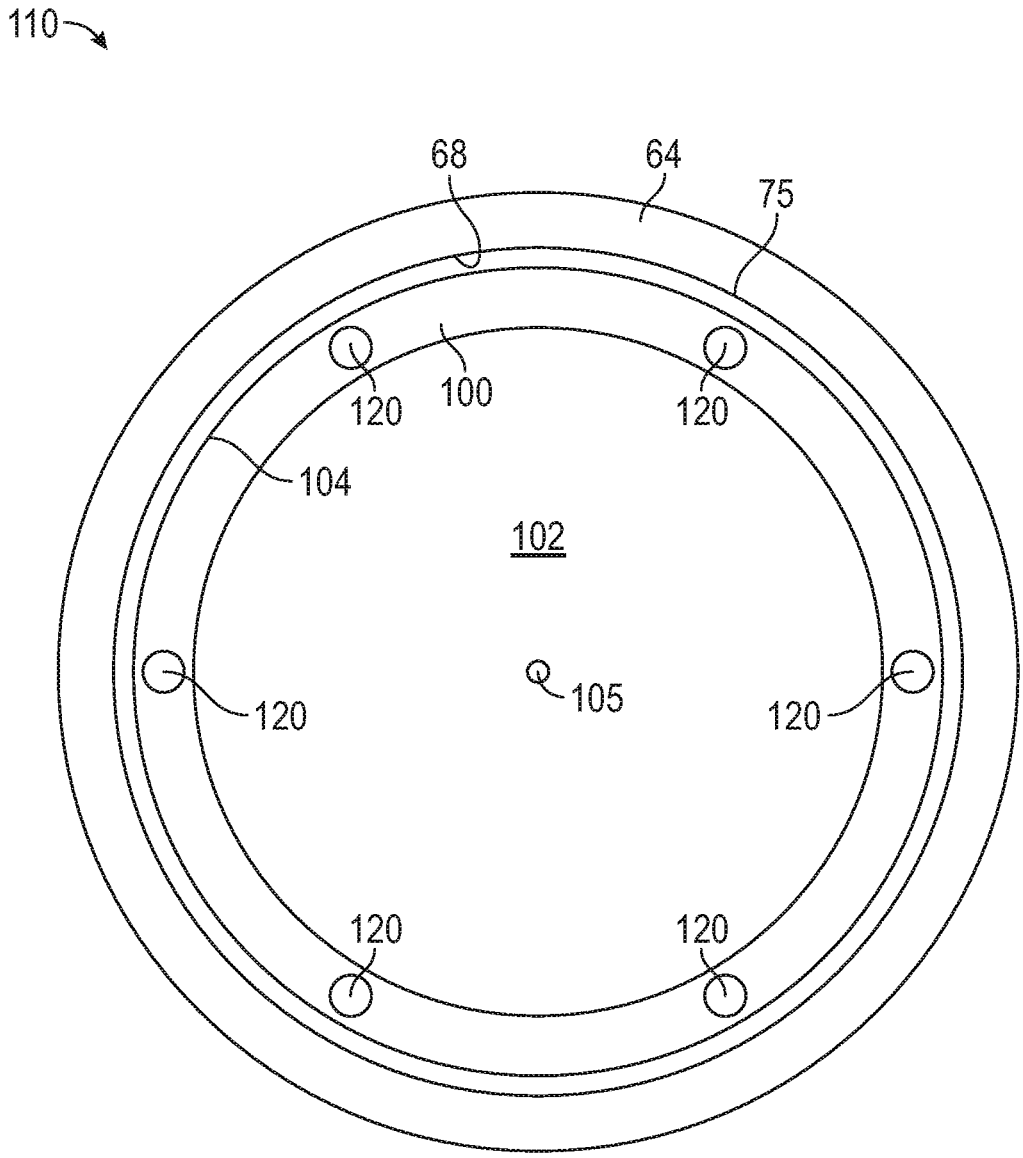
FIG. 4 is a schematic, top cross-sectional view of an embodiment of a plurality of landing sensors of the wellhead assembly system of FIG. 2A in accordance with principles disclosed herein.
Figure 6:
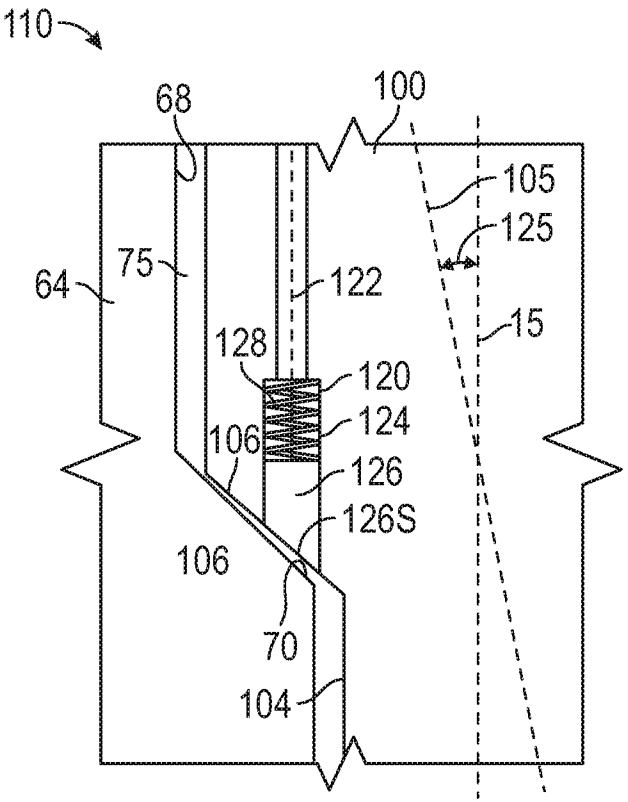
FIG. 6 is a schematic, side cross-sectional view of the landing sensor of FIG. 4, the landing sensor shown in a second position.
Figure 5:
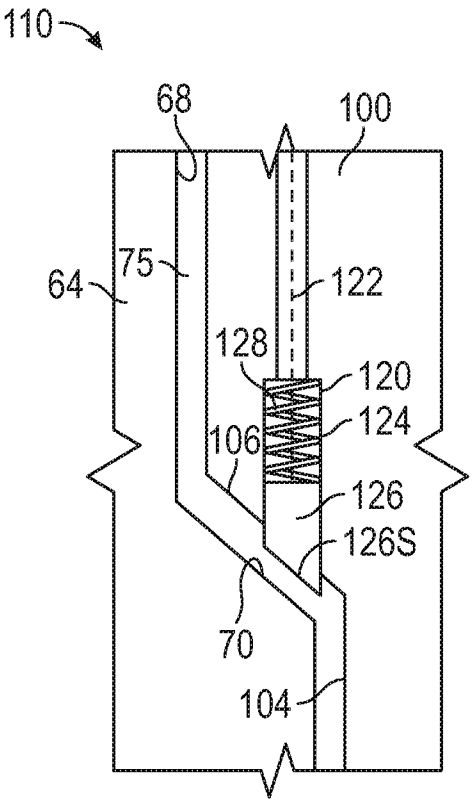
FIG. 5 is a schematic, side cross-sectional view of a landing sensor of FIG. 4, the landing sensor shown in a first position.

Referring to FIGS. 2 and 4-6, an embodiment of landing sensors 120 is shown in FIGS. 4-6. Particularly, FIG. 4 illustrates a plurality of landing sensors 120 positioned circumferentially along landing profile 106 of hanger 100, FIG. 5 illustrates a landing sensor 120 disposed in an open or disengaged position, and FIG. 6 illustrates a landing sensor 120 disposed in a closed or engaged position. In the embodiment shown, each landing sensor 120 generally includes an electrical cable 122 extending through a passage within hanger 100, a receptacle 124 extending into hanger 100 from landing profile 106, an electrical sensor or switch 126 disposed in receptacle 124, and a biasing member 128 extending between an inner end of receptacle 124 and the switch 126. In this embodiment, switch 126 is coupled and in signal communication with cable 122, and comprises a pressure or contact switch configured to transmit a signal along cable 122 in response to contacting or physically engaging the landing profile 70 of spool 64. However, in other embodiments, switch 126 may comprise a proximity sensor configured to transmit a signal along cable 122 corresponding to the distance between an outer surface 126*s* of switch 126 and the landing profile 70 of spool 64. Cable 122 of landing sensor 120 is in signal communication with ECM 502 of tool 200 shown in FIG. 1. In certain embodiments, cable 122 may be connected to ECM 502 through a hardwired connection extending between hanger 100 and tool 200 that is disconnected as tool 200 is retrieved from wellhead 50 following installation of hanger 100; however, in other embodiments, cable 122 may be connected to ECM 502 wirelessly through a wireless transmitter in hanger 100 or an inductive coupling between hanger 100 and tool 200.

In the arrangement described above, biasing member 128 is configured to bias switch 126 such that the outer surface 126*s* of switch 126 protrudes from the landing profile 106 of hanger 100 towards landing profile 70 of spool 64. Thus, engagement between outer surface 126*s* of switch 126 and landing profile 70 acts to retract or displace switch 126 into receptacle 124, as shown particularly in FIG. 6. However, once hanger 100 is lifted from landing profile 70 of spool 64, thereby providing clearance between mating landing profiles 106 and 70, biasing member 128 will act to displace or extend switch 126 from receptacle 124 such that outer surface 126*s* of switch 126 protrudes from landing profile 106 of hanger 100. In this manner, as hanger 100 is being installed within spool 64 but prior to contact between landing profile 106 and of hanger 100 and landing profile 70 of spool 64 (shown particularly in FIG. 5), the switch 126 of a particular landing sensor 120 is disposed in the open position and thus will not transmit a signal to ECM 502 via cable 122, indicating that the arcuate portion of landing profile 106 disposed proximal the particular landing sensor 120 has not contacted a corresponding arcuate portion of landing profile 70. Following contact between the respective portions of landing profiles 106 and 70, the switch 126 of the particular landing sensor 120 is actuated into the closed position, thereby transmitting an engagement signal to ECM 502 via cable 122 that the arcuate portion of landing profile 106 proximal the landing sensor 120 has engaged the corresponding arcuate portion of landing profile 70. As will be discussed further herein, the engagement signal transmitted to ECM 502 may be transmitted to the drilling platform of well system 10 for indication of the engagement to personnel of well system 10; however, in other embodiments, ECM 502 may be configured to utilize the engagement signal provided by the closed landing sensor 120 as part of an automated control system for installing hanger 100 and packoff assembly 112 within spool 64.

Given the circumferentially spaced arrangement of landing sensors 120 shown particularly in FIG. 4, landing sensors 120 may be used to determine and indicate an angular misalignment 125 between longitudinal axis 105 of hanger 100 and the longitudinal axis of spool 64 (i.e., longitudinal axis 15) (shown in FIG. 6). Particularly, in the event of angular misalignment 125 between the axes of hanger 100 and spool 64, only a portion of landing sensors 120 will register and transmit an engagement signal to ECM 502 in response to physical engagement between the landing profile 106 of hanger 100 and the landing profile 70 of spool 64. In other words, in the event of angular misalignment 125 only an arcuate portion of landing profile 106 will engage landing profile 70, with those landing sensors 120 disposed on the engaged arcuate portion of landing profile 106 transmitting an engagement signal to ECM 502. In this manner, ECM 502 may transmit the information received from landing sensors 120 to the drilling platform to indicate to personnel of well system 10 that only particular landing sensors 120 of hanger 100 have transmitted an engagement signal, and thus, angular misalignment 125 has occurred between hanger 100 and spool 64.

Moreover, the particular landing sensors 120 registering engagement may be indicated to personnel of well system 10, thereby indicating which arcuate portion of landing profile 106 has engaged landing profile 70, or in other words, the direction of the angular misalignment 125 between longitudinal axis 105 and the longitudinal axis of spool 64. The information provided by ECM 502 may be used by personnel of well system 10 (or by ECM 502 in an automated control system) to adjust the angular orientation of longitudinal axis 105 to align axis 105 with the axis of spool 64, such as by manipulating the position of tool 200 or the platform from which conveyance tool 20 extends. Thus, the information provided by landing sensors 120 may be utilized to correct the angular positioning of hanger 100 within spool 64 in real-time and prior to the completion of the installation of hanger 100 within spool 64 and the assembly of wellhead 50, after which repositioning hanger 100 may incur additional expenses and other problems, such as the removal of cured cement affixing hanger 100 into position.

Figure 7:
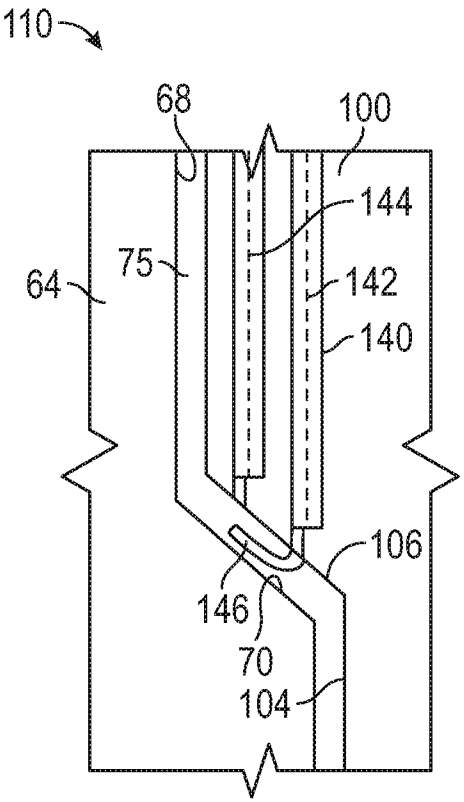
FIG. 7 is a schematic, side cross-sectional view of another embodiment of a landing sensor of the wellhead assembly system of FIG. 2A in accordance with principles disclosed herein.

Referring to FIGS. 2 and 7, another embodiment of a landing sensor 140 for use with hanger 100 and wellhead assembly system 110 is shown. Landing sensor 140 operates similarly to landing sensor 120, and thus, includes an open or disengaged position (shown in FIG. 7) and a closed or engaged position, where in the closed position the landing sensor 140 transmits an engagement signal to ECM 502. In the embodiment shown, landing sensor 140 includes a first cable 142, a second cable 144, and a flexible switch 146 biased into a position protruding from landing profile 106 of hanger 100. In this arrangement, physical engagement of landing profiles 106 and 70 proximal landing sensor 140 forces switch 146 to flex inwardly into contact with an electrical contact coupled to second cable 144, thereby completing the circuit between cables 142 and 144 and transmitting an engagement signal to ECM 502. However, when landing profiles 106 and 70 are not engagement, switch 146 is not in signal communication with second cable 144, thereby preventing transmission of an engagement signal to ECM 502.

Figure 8:
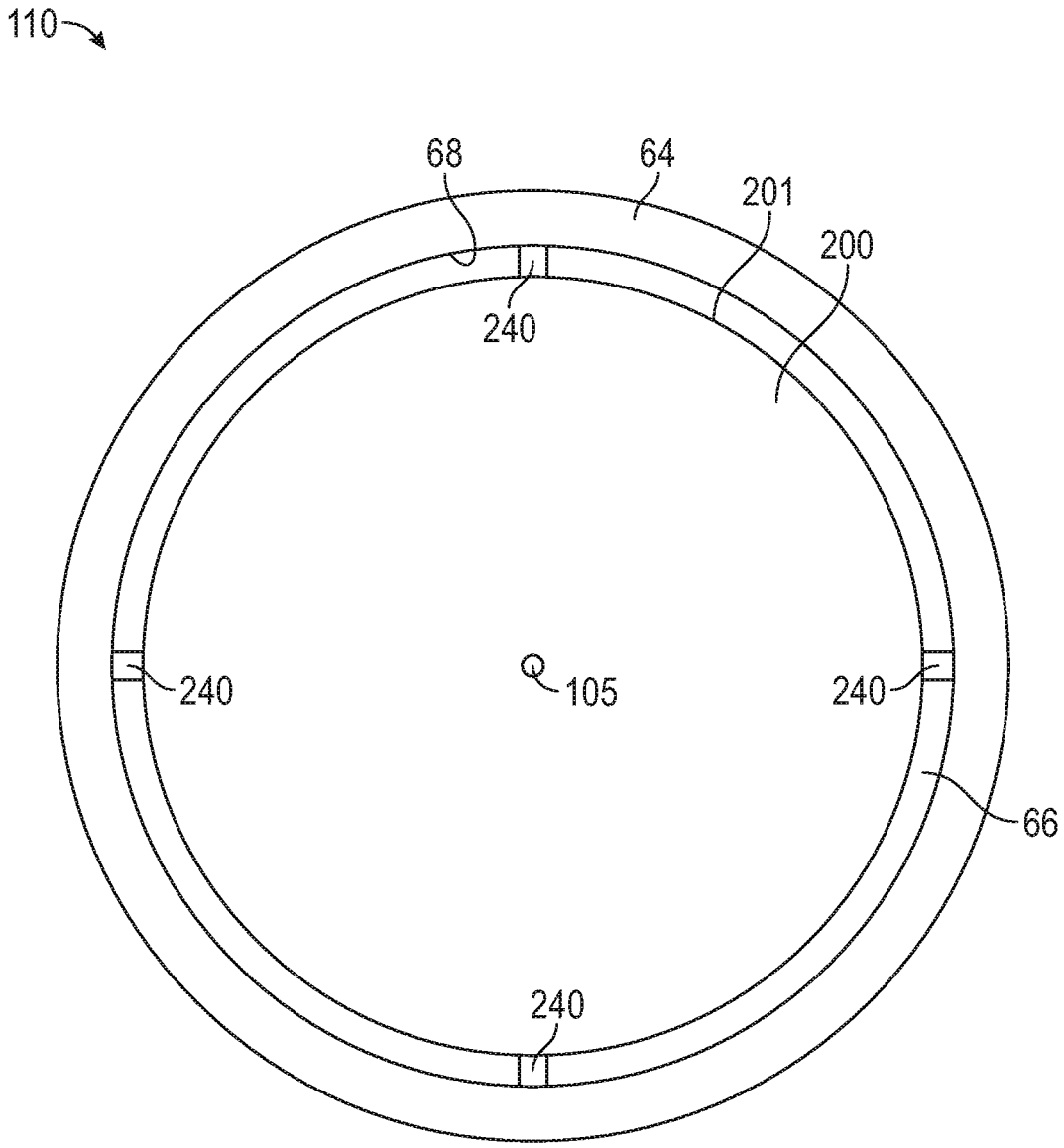
FIG. 8 is a schematic, top cross-sectional view of an embodiment of a plurality of alignment sensors of the wellhead assembly system of FIG. 2A in accordance with principles disclosed herein.
Figure 9:
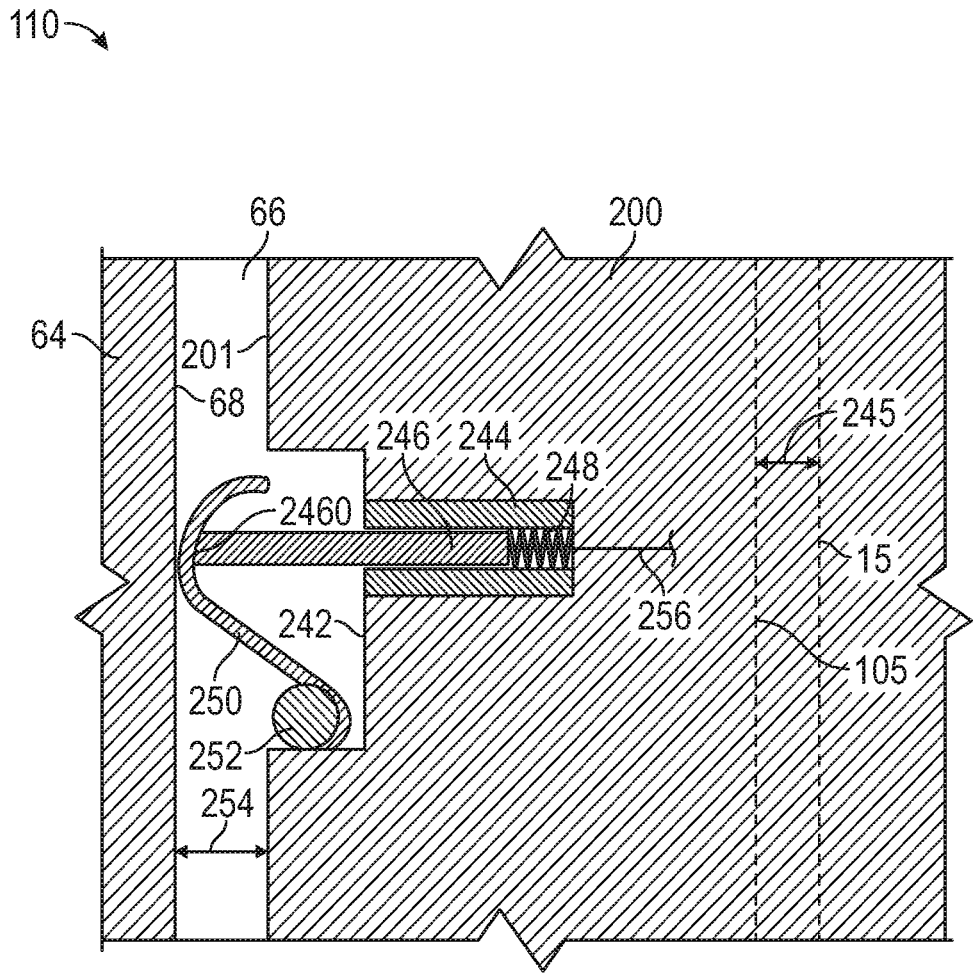
FIG. 9 is a schematic, side cross-sectional view of an alignment sensor of FIG. 8.

Referring to FIGS. 2, 8, and 9, an embodiment of an alignment sensor 240 of tool 200 is shown. As described above, alignment sensors 240 are configured to measure the radial alignment of longitudinal axis 105 of hanger 100 and the longitudinal axis of spool 64. In the embodiment shown, each alignment sensor 240 generally includes a receptacle 242 extending into the outer surface 201 of tool 200, a linear variable differential transformer (LVDT) position sensor 244 disposed in tool 200, a sensor pin 246 slidably disposed in position sensor 244, a biasing member 248 in engagement with sensor pin 246, and a contactor 250 pivotally coupled to tool 200 at a pivot point 252. In this embodiment, pivot point 252 includes a biasing member to bias contactor 250 into a radially outwards (respective longitudinal axis 105) position distal receptacle 242 such that an outer contacting surface of contactor 250 will contact and physically engage the inner surface 68 of spool 64 once tool 200 has entered bore 66 of spool 64. In conjunction with the biasing action provided by pivot point 252, biasing member 248 biases sensor pin 246 into a radially outwards position respective position sensor 244 to maintain physical engagement between a radially outer end 246*o* of sensor pin 246 and the contactor 252. In this manner, contactor 250 and sensor pin 246 are configured to maintain contact with inner surface 68 of spool 64 irrespective in variations in radial clearance or distance 254 between outer surface 201 and inner surface 68 as tool 200 is displaced through bore 66 of spool 64 during the installation of hanger 100 therein.

Although in the embodiment shown alignment sensors 240 each comprise an LVDT position sensor 244, in other embodiments, each alignment sensor 240 may comprise a proximity sensor, such as an infrared proximity sensor, configured to measure the distance between outer surface 201 of tool 200 and inner surface 68 of spool 64 without needing to maintain physical contact between alignment sensor 240 and surface 68. In this embodiment, position sensor 244 is configured to measure the position of sensor pin 246 within position sensor 244 (correlated to the width of radial clearance 254) and transmit an alignment signal corresponding to the position of sensor pin 246 to ECM 502 via a cable 256 in signal communication with both ECM 502 and sensor 244. Thus, as clearance 254 increases biasing member 248 displaces sensor pin 246 away from position sensor 244, and as clearance 254 decreases sensor pin 246 is displaced towards position sensor 244, where the movement of sensor pin 246 within position sensor 244 is continuously measured by sensor 244 and transmitted to ECM 502 via cable 256, where the alignment signal may be transmitted to the platform or rig for indication to personnel of well system 10, or utilized by ECM 502 for the automated control of well assembly system 110.

Moreover, given that alignment sensors 240 are disposed circumferentially along outer surface 201 of tool 200, alignment sensors 240 may be utilized to determine the radial offset between longitudinal axis 105 (disposed coaxial with the longitudinal axis of tool 200) and the longitudinal axis of spool 64. Particularly, in the event of a radial offset between tool 200 and spool 64, the measurement indication of clearance 254 provided in real-time by each alignment sensor 240 will differ, with one or more landing sensors in the direction of the radial offset registering a relatively smaller clearance 254 than the alignment sensors 240 disposed away from the direction of the radial offset. For example, if tool 200 moves from left to right relative spool 64, the leftmost alignment sensor 240 will register a smaller clearance 254 than the rightmost alignment sensor 240 positioned on outer surface 201 of tool 200. In this manner, landing sensors 240 not only indicate the presence of radial misalignment 245 between longitudinal axis 105 of hanger 100 and the longitudinal axis of spool 64, but the direction of the radial misalignment 245 given the known position of each alignment sensor 240 along the outer surface 201 of tool 200. Thus, personnel of well system 10 (or ECM 502 in an automated control system) may adjust the radial position of tool 200 and hanger 100 within spool 64 (e.g., by manipulating conveyance tool 20 or the platform from which tool 20 extends) in light of the directional information provided in real-time by the circumferentially spaced alignment sensors 240.

Figure 10:
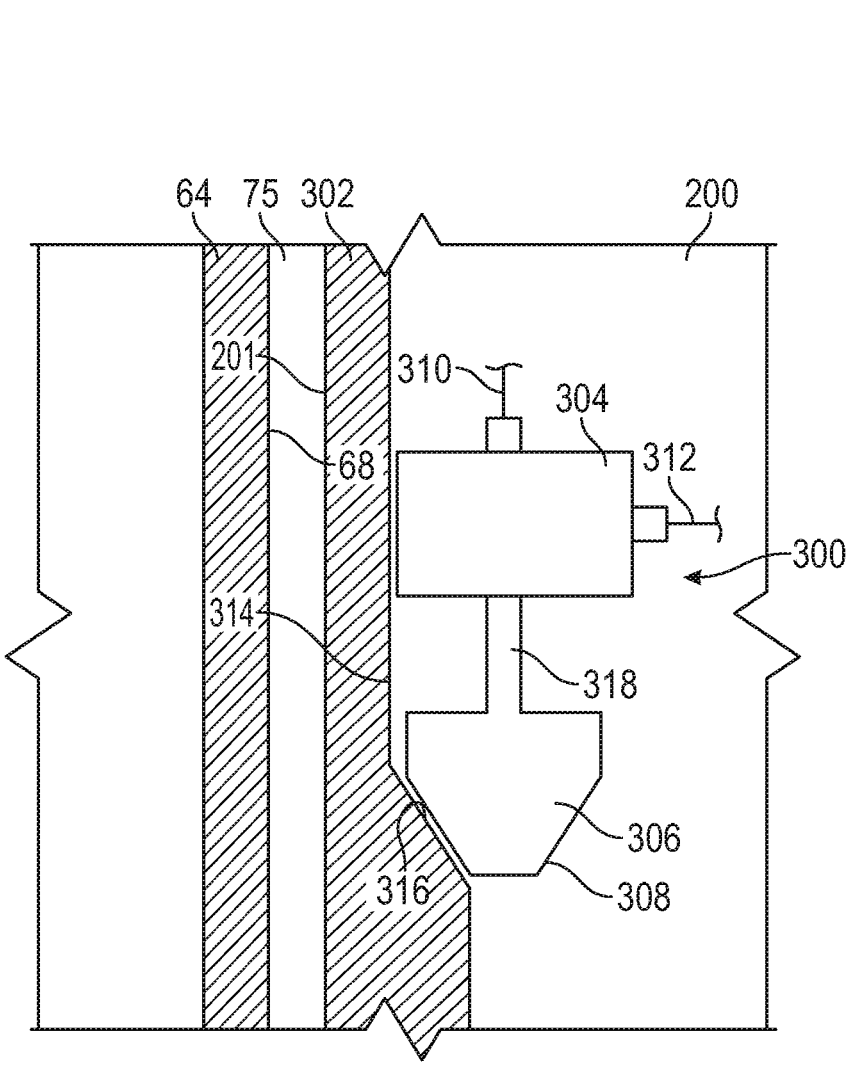
FIG. 10 is a schematic, side cross-sectional view of an embodiment of a torque application assembly of the wellhead assembly system of FIG. 2A in accordance with principles disclosed herein.

Referring to FIGS. 2 and 10, an embodiment of torque application assembly 300 is shown in FIG. 10 for providing a torque to rotational member 302 of tool 200. In the embodiment shown, torque application assembly 300 is disposed within tool 200 and generally includes a hydraulic motor 304 rotationally coupled to a gear or engagement member 306, the gear 306 including an angled or beveled toothed interface 308 for imparting a torque to rotational member 302. Hydraulic motor 304 includes a first or inlet port 310 and a second or outlet port 312, where inlet port 310 is in fluid communication with fluid passage 210 (shown in FIG. 3) for providing pressurized fluid to power hydraulic motor 304. In certain embodiments, an electrically actuated valve is interposed between inlet port 310 of hydraulic motor 304 and passage 210 to control the actuation of motor 304, where the actuation of the valve is controlled by ECM 502. Moreover, while in the embodiment shown torque application assembly 300 comprises hydraulic motor 304, in other embodiments, torque application assembly 300 may include an electric motor controlled by ECM 502 for applying a torque to gear 306. In certain embodiments, outlet port 312 is in fluid communication with a fluid passage or reservoir disposed in tool 200 for circulation to other hydraulically actuated tools or components of tool 200. In other embodiments, outlet port 312 is in fluid communication with a vent (not shown) extending through outer surface 201 of tool 200 for venting fluid to the surrounding environment. In still other embodiments, fluid flow through hydraulic motor 304 may be reversed with pressurized fluid entering outlet port 312 and exiting inlet port 310 to rotate gear 306, and rotational member 302 in turn, in the opposite rotational direction.

In the embodiment shown, rotational member 302 comprises an annular member disposed coaxial with longitudinal axis 105 of hanger 100 and including an outer surface defined by outer surface 201 of tool 200 and a generally cylindrical inner surface 316. Inner surface 316 includes an angled or beveled toothed engagement profile 316 for interlocking engagement with the beveled interface 308 of gear 306. Torque application assembly 300 is configured to receive pressurized fluid from passage 210 via inlet port 310, and convert some of the energy of the pressurized fluid into torque via hydraulic motor 304, thereby expelling a fluid from outlet port 312 having a reduced pressure respective the fluid entering inlet port 310. Torque generated by hydraulic motor 304 is then applied to gear 306 via a gear shaft 318 extending into motor 304, where torque applied to gear 306 is applied to rotational member 302 via the toothed interface between toothed interface 308 of gear 306 and toothed engagement profile 316 of rotational member 302. Thus, the input of pressurized fluid to inlet port 304 is translated into torque applied to rotational member 302 via torque application assembly 300.

In the embodiment shown in FIG. 2A, rotational member 302 is coupled to annular packoff assembly 112, and thus, application of torque to rotational member 302 via torque application assembly 300 is transferred to packoff assembly 112 for setting packoff assembly 112 such that annulus 75 between spool 64 and hanger 100 is sealed via packoff 112. Rotational member 302 is also coupled with hanger 100, and thus, may be employed to rotate hanger 100 to install hanger 100 within spool 64. In this manner, the application of torque to rotational member 302 via torque application assembly 300 results in rotation of rotational member 302 and packoff assembly 112 relative tool 200 and hanger 100. In certain embodiments, packoff assembly 112 is set following the landing of hanger 100 within spool 64 using landing sensors 120 and alignment sensors 240. Thus, using torque application assembly 300, packoff assembly 112 may be torque or rotationally set without rotating or applying a torque to string 22. Applying a torque to string 22 may increase the total torque or power required for setting packoff assembly 112 given that string 22, which may extend thousands of feet in offshore applications, must transfer the torque to the packoff assembly 112, and at least a portion of the torque applied to string 22 will result in strain or deformation of string 22, reducing the amount of torque transferred to packoff assembly 112. Moreover, torque and rotation of string 22 results in applied loads against sensitive components of well system 10, such as relatively small diameter hydraulic and electrical lines extending along and coupled with string 22, jeopardizing the structural integrity and functionality of such components.

Therefore, by converting the already available hydraulic pressure provided by string 22 into torque at the tool 200, efficiency of torque transfer to the tool or component being set (e.g., packoff assembly 112, hanger 100, etc.), as well as minimizing the possibility of damaging or disrupting other components of well system 10.

Figure 11:
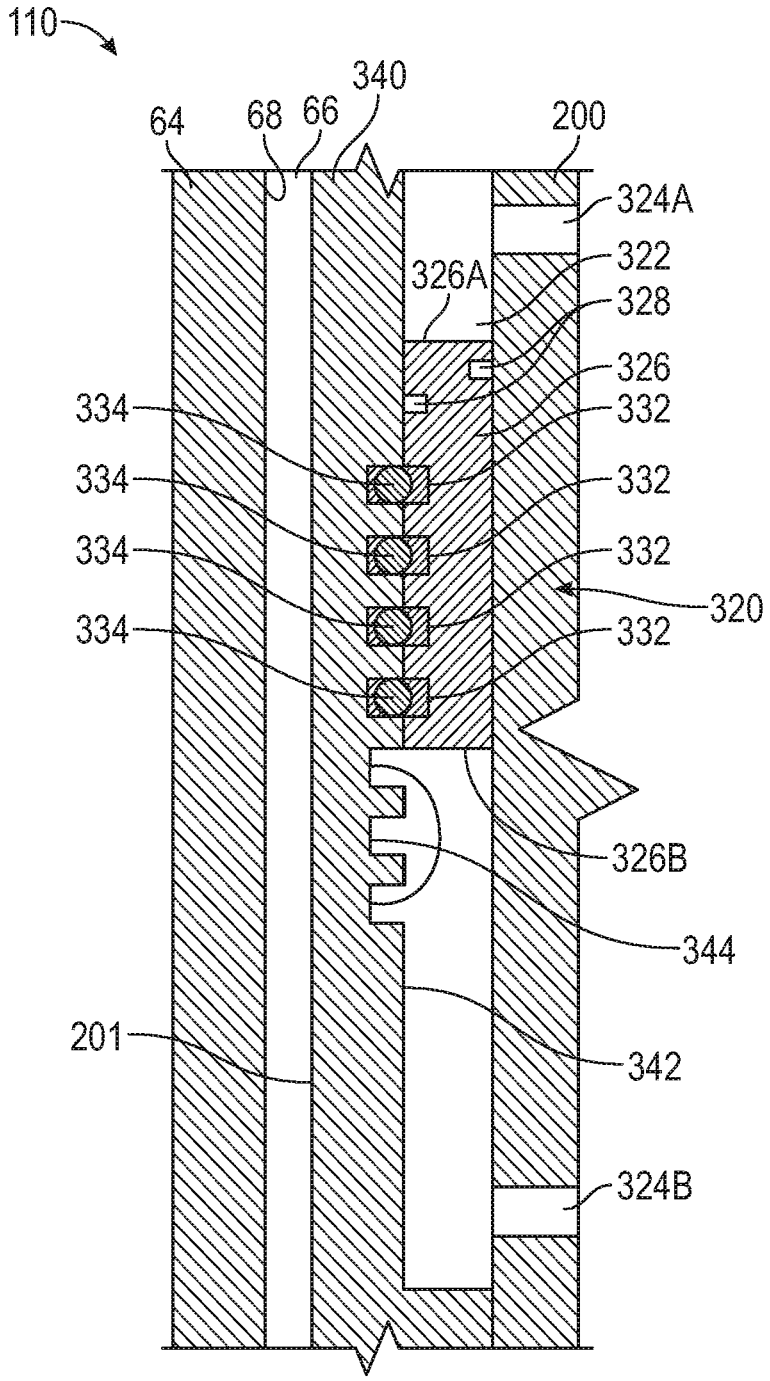
FIG. 11 is a schematic, side cross-sectional view of another embodiment of a torque application assembly of the wellhead assembly system of FIG. 2A in accordance with principles disclosed herein.
Figure 12:
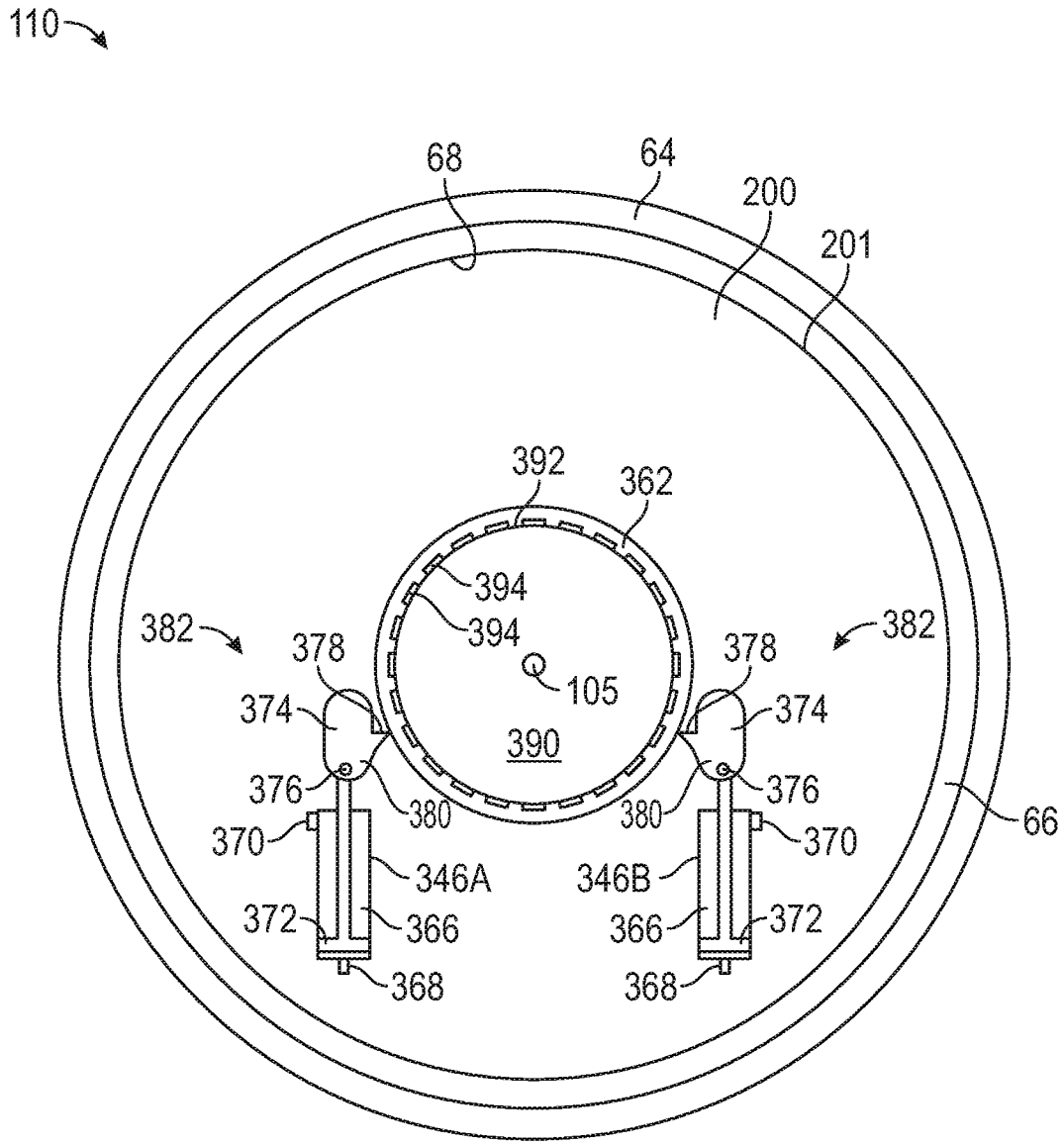
FIGS. 12-14B are schematic, top cross-sectional views of another embodiment of a torque application assembly of the wellhead assembly system of FIG. 2A in accordance with principles disclosed herein.
Figure 13A:
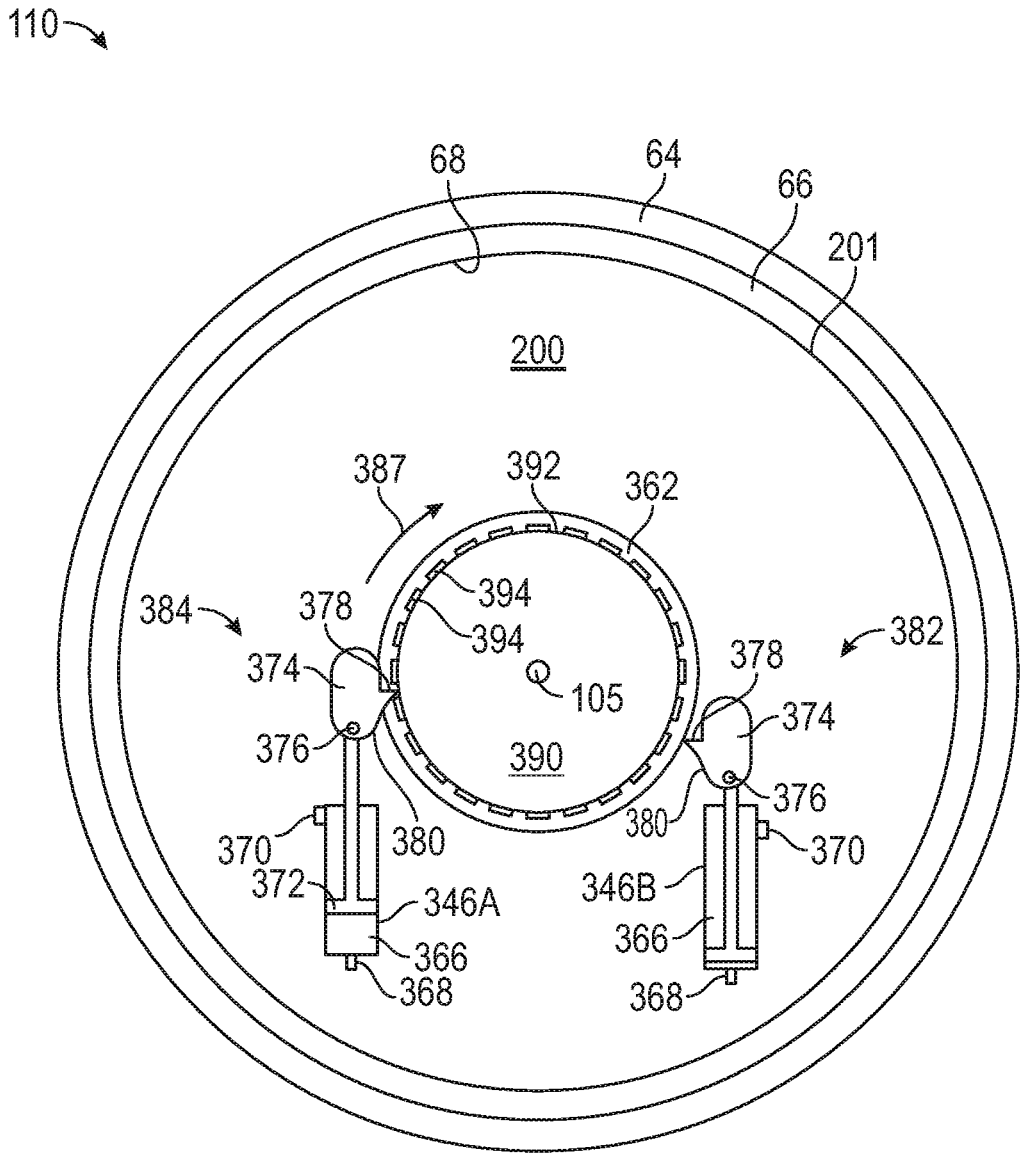
Figure 13B:
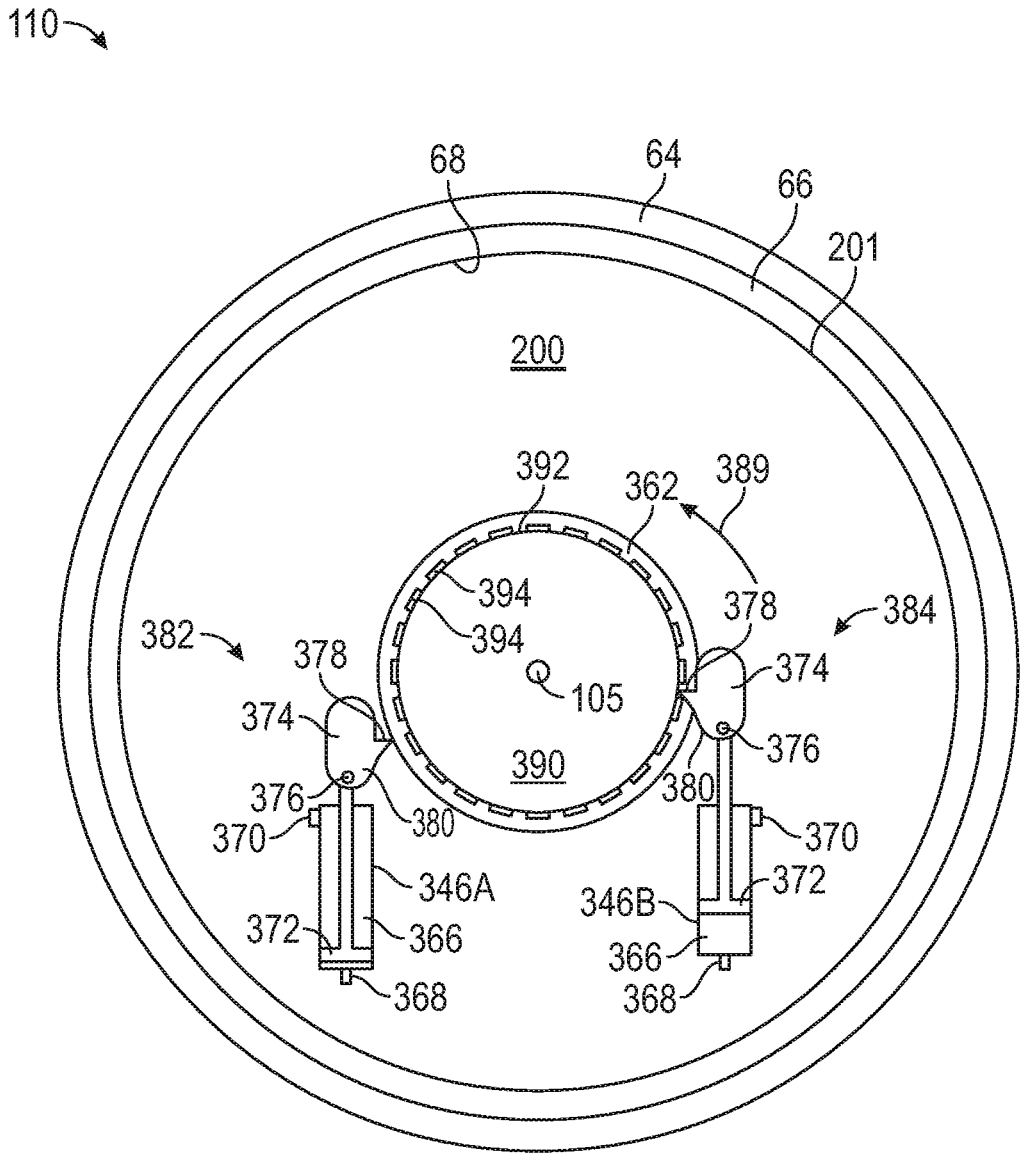

Referring to FIGS. 2 and 11, another embodiment of a torque application assembly 320 and a rotational or engagement member 340 are shown, where torque application assembly 320 and rotational member 340 are configured for use with tool 200 in lieu of, or in conjunction with, torque application assembly 300 and rotational member 302 discussed above. In the embodiment shown, torque application assembly 320 generally includes an annular recess or chamber 322 disposed in tool 200, an annular actuation member 326, and a plurality of ball bearings 334. Particularly, chamber 322 includes a first or upper fluid port 324*a* and a second or lower fluid port 324*b*, where ports 324*a* and 324*b* are disposed proximal the axial ends (relative longitudinal axis 105) of chamber 322. Actuation member 326 is disposed in chamber 322 axially between ports 324*a* and 324*b* and includes a pair of annular seals 328 for sealing against opposing surfaces of chamber 322, thereby restricting fluid communication between ports 324*a* and 324*b*.

Actuation member 326 is configured to convert hydraulic pressure or flow applied thereto into rotation of rotational member 340. In the embodiment shown, actuation member 326 includes a first or upper endface 326*a* disposed distal lower port 324*b* and a second or lower endface 326*b* disposed distal upper port 324*a*. Actuation member 326 also includes a helical groove 332 extending into a radially outer (relative longitudinal axis 105) surface 330 of member 326, where helical groove 332 partially receives ball bearings 334. In certain embodiments, actuation member 326 further includes a recirculation pathway or circuit (not shown) for recirculating ball bearings 334 between terminal ends of helical groove 332. In the embodiment shown, rotational member 340 is generally annular and includes an outer surface defined by outer surface 201 of tool 200 and a generally cylindrical inner surface 342 partially defining chamber 322, where inner surface 342 is sealingly engaged by one of the pair of annular seals 328 of actuation member 326. In this embodiment, an axially extending portion of the inner surface 342 of rotational member 340 comprises a helical groove 344 extending therein that partially receives each ball bearing 334. In this manner, each ball bearing 334 is placed into interlocking engagement with helical groove 344 of rotational member 342 and helical groove 332 of actuation member 326.

To apply a torque or rotate rotational member 340, fluid flow or pressure may be provided to either upper port 324*a* or lower port 324*b*, causing a differential pressure to be applied across endfaces 326*a* and 326*b* of actuation member 326 due to the sealing engagement provided by annular seals 328. The differential pressure applied across actuation member 326 results in a net axial force being applied to actuation member 326, which is translated into a torque applied against rotational member 340 in response to the interlocking engagement between helical grooves 332 and 344 via the ball bearings 334 disposed therebetween, where the rotational torque applied against rotational member 340 may be used to set packoff assembly 112 or other components of wellhead 50. In other embodiments, rotational member 340 is coupled to hanger 100 for rotating hanger 100 during installation. In this manner, axial displacement of actuation member 326 within chamber 322 is translated into rotational motion of rotational member 340 via the helical travel of ball bearings 334 through helical grooves 332 and 344. Thus, the pressurization of upper port 324*a* and concurrent depressurization of lower port 324*b* results in an axial downward force applied against actuation member 326 and a concomitant torque applied against rotational member 340 in a first rotational direction, while the pressurization of lower port 324*b* and concurrent depressurization of upper port 324*a* results in an axial upwards force applied against actuation member 326 and a concomitant torque applied against rotational member 340 in a second rotational direction. In the embodiment shown, ports 324*a* and 324*b* are in fluid communication with passage 210 shown in FIG. 3 for receiving fluid pressure. Further, similar to the operation of torque application assembly 300, the pressurization of ports 324*a* and 324*b* may be controlled via electrically actuated valves controlled by ECM 502. As shown in FIG. 11 and described above, torque application assembly 320 comprises a ball screw actuator; however, in other embodiments, torque application assembly 320 may comprise other linear actuators known in the art that comprise helical threads and configured to translate an axial force into a torque for rotational motion.

Referring to FIGS. 2 and 12-14B, another embodiment of a torque application assembly 360 and a rotational or engagement member 390 are shown, where torque application assembly 360 and rotational member 390 are configured for use with tool 200 in lieu of, or in conjunction with, torque application assemblies 300, 320, and rotational members 302, 340, discussed above. In the embodiment shown, torque application assembly 360 generally includes a cylindrical bore 362 extending axially through tool 200, and a plurality of actuatable ratchet assemblies 364 (shown as 364*a* and 364*b*) mounted within tool 200 and disposed circumferentially about bore 362. Particularly, a first ratcheting assembly 364*a* is positioned at one diametrical end of bore 362 while a second ratcheting assembly 364*b* is disposed at the opposing diametrical end of bore 362. In the embodiment shown, each ratchet assembly 364 generally includes a cylinder 366 having a first port 368 and a second port 370, a piston 372 disposed in the cylinder 366, and an engagement or ratchet member 374 pivotally coupled to a terminal end of a connecting rod extending from piston 372 at a pivot point 376. First and second ports 368 and 370 are in fluid communication with passage 210 shown in FIG. 3 and may selectively receive hydraulic pressure or flow in response to the actuation of one or more electrically actuated valves controlled by ECM 502. Moreover, while in the embodiment each ratcheting assembly 364 of torque application assembly 360 includes a hydraulically actuated piston 372, in other embodiments, ratcheting assemblies 360 may be electrically actuated via actuators controlled by ECM 502.

In the embodiment shown, rotational member 390 is centrally disposed within bore 362 of tool 200 and includes a generally cylindrical outer surface 392, where outer surface 392 includes a plurality of circumferentially positioned teeth or splines 394 extending therefrom. The ratchet member 374 of each ratcheting assembly 364 includes a tooth 378 extending thereon for matingly engaging a corresponding tooth 394 of rotational member 390. Tooth 378 includes a sloped backside surface 380 configured to allow ratchet member 374 to retract towards cylinder 366 without catching or engaging the teeth 394 of rotational member 390. In certain embodiments, pivot 376 of each ratcheting assembly 364 includes a biasing member (not shown) for biasing its respective ratchet member 374 radially inwards (relative longitudinal axis 105) and into physical or interlocking engagement with a corresponding tooth 394 of rotational member 390.

Figure 14A:
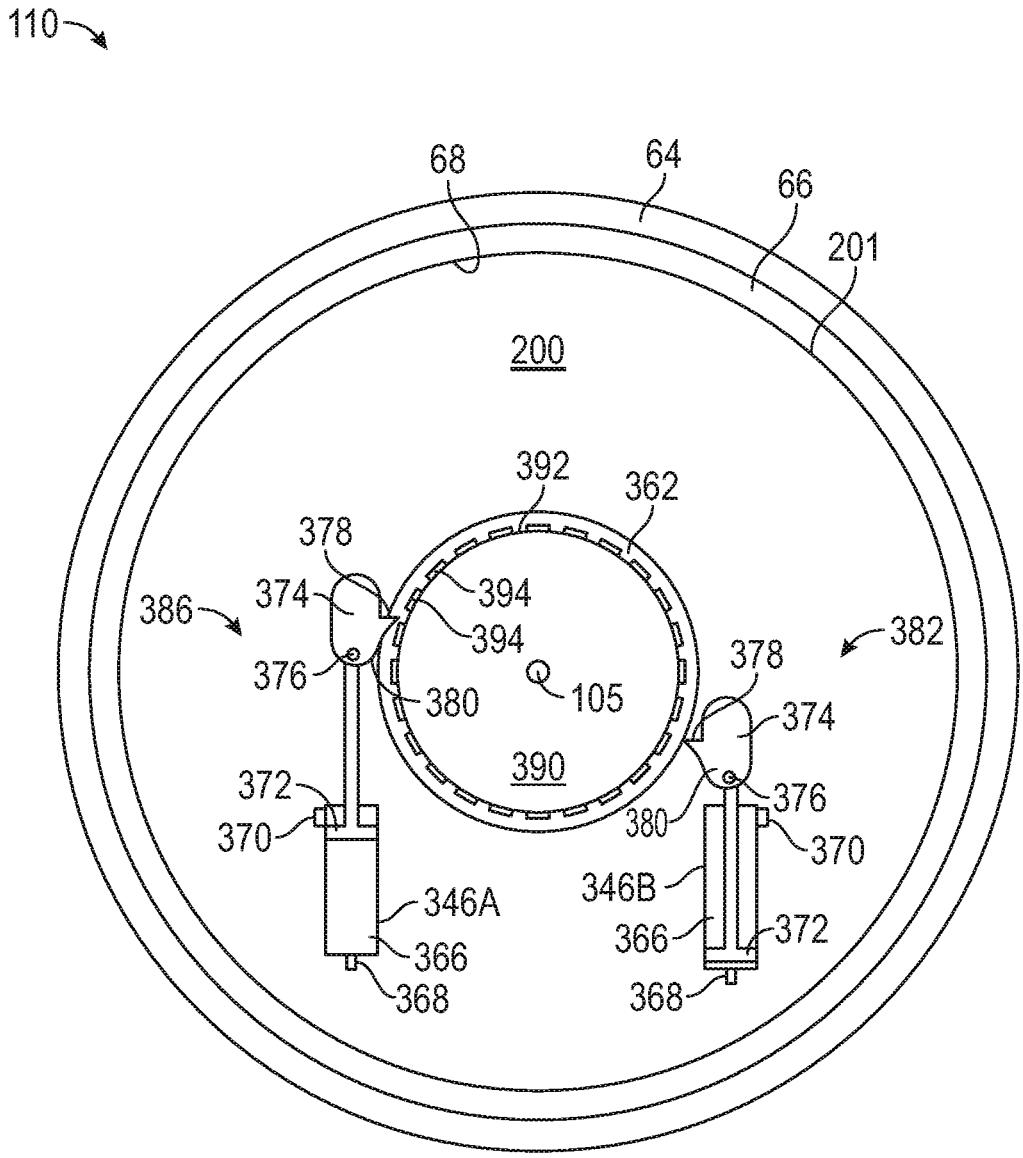
Figure 14B:
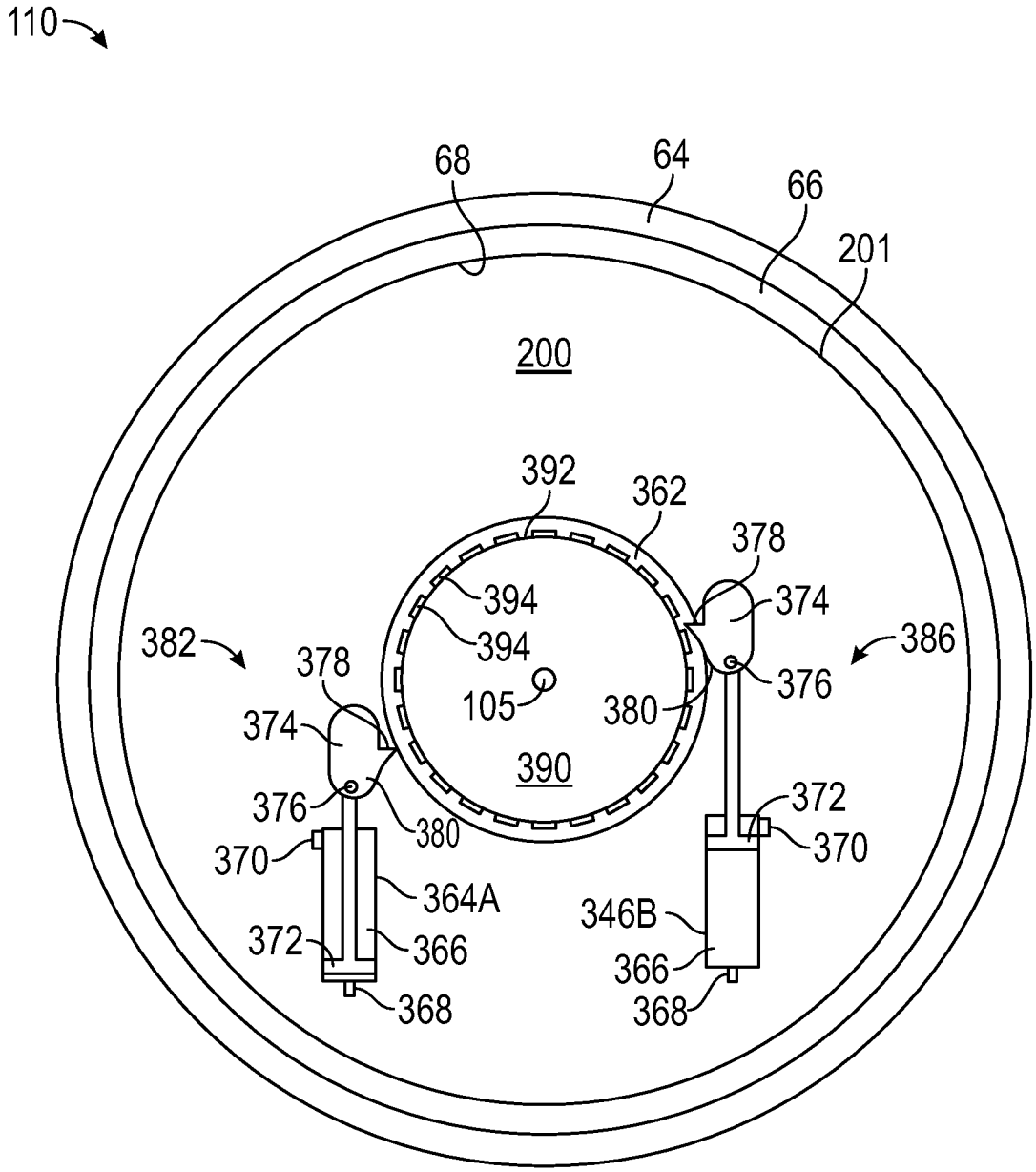

In the embodiment shown, each ratcheting assembly 364 includes a first or retracted position 382, a second or engaged position 384 (shown in FIGS. 13A and 13B), and a third or extended position 386 (shown in FIGS. 14A and 14B). Each ratcheting assembly 364 may be actuated between positions 382, 384, and 386 by creating a pressure different differential across piston 372 in response to pressurizing either first port 368 or second port 370 while depressurizing the opposing port 370 or 368. Specifically, pressurization of first port 368 and concomitant depressurization of second port 370 of a ratcheting assembly 364 disposed in retracted position 382 causes piston 372 to be displaced through cylinder 366 and the ratcheting assembly 364 to actuate from retracted position 382 to the engaged position 384, and from the engaged position 384 to the extended position 386. Conversely, with a ratcheting assembly 364 disposed in extended position 386, pressurization of second port 370 and concomitant depressurization of first port 368 causes piston 372 to be displaced through cylinder 366 in an opposing direction, resulting in actuation of the ratcheting assembly 364 from the extended position 386 to the engaged position 384, and from engaged position 384 to the retracted position 382.

In the arrangement described above, rotational member 390 may be rotated in a first rotational direction 387 (shown in FIG. 13A) and a second rotational direction (FIG. 13B) by actuating ratcheting assemblies 364 between positions 382, 384, and 386. As shown particularly in FIG. 12, when both first and second ratcheting assemblies 364*a* and 364*b* are disposed in the retracted position 382, the ratchet member 374 of each assembly 364*a* and 364*b* is disposed distal rotational member 390 with tooth 378 disengaged from teeth 394 of rotational member 390. To rotate rotational member 390 in the first direction 387, while second ratcheting assembly 364*b* is held in retracted position 382, first ratchet assembly 364*a* is actuated from the retracted position 382 into the engaged position 384 as described above, where tooth 378 of ratchet member 374 physically engages a corresponding tooth 394 of rotational member 390. Continued actuation of first ratchet assembly 364*a* from the engaged position 384 to the extended position 386 translates the pressure force applied against piston 372 of first assembly 364*a* into a torque applied against rotational member 390 via the physical engagement between mating teeth 378 and 394, where the applied torque rotates rotational member 390 in first direction 387 to set a component of wellhead 50, such as packoff assembly 112 and hanger 100.

Continued rotation of rotational member 390 in first direction 387 may be accomplished by continually reciprocating first ratcheting assembly 364*a* between the retracted position 386 and the engaged position 384 while second ratcheting assembly 364*b* is disposed in retracted position 382. Specifically, as first assembly 364*a* is actuated from the extended position 386 to the engaged position 384 as described above, teeth 394 of rotational member 390 slidingly engage sloped surface 380 of ratchet member 374, allowing ratchet member 374 to slide against the outer surface 392 of rotational member 390 without becoming caught on teeth 394. Once in engaged position 384, first ratcheting assembly 364*a* may be again actuated into the extended position 386 to rotate rotational member 390 in first direction 387. Similarly, rotational member 390 may be rotated in second direction 389 by actuating second ratcheting assembly 364*b* from the retracted position 382 to the extended position 386 while first ratcheting assembly 364*a* is held in retracted position 382. Further, continual rotation of rotational member 390 in second direction 389 may be accomplished via reciprocating second ratcheting assembly 364*b* between the extended and engaged positions 386 and 384, respectively, while first ratcheting assembly 364*a* is held in retracted position 382.

Figure 15:
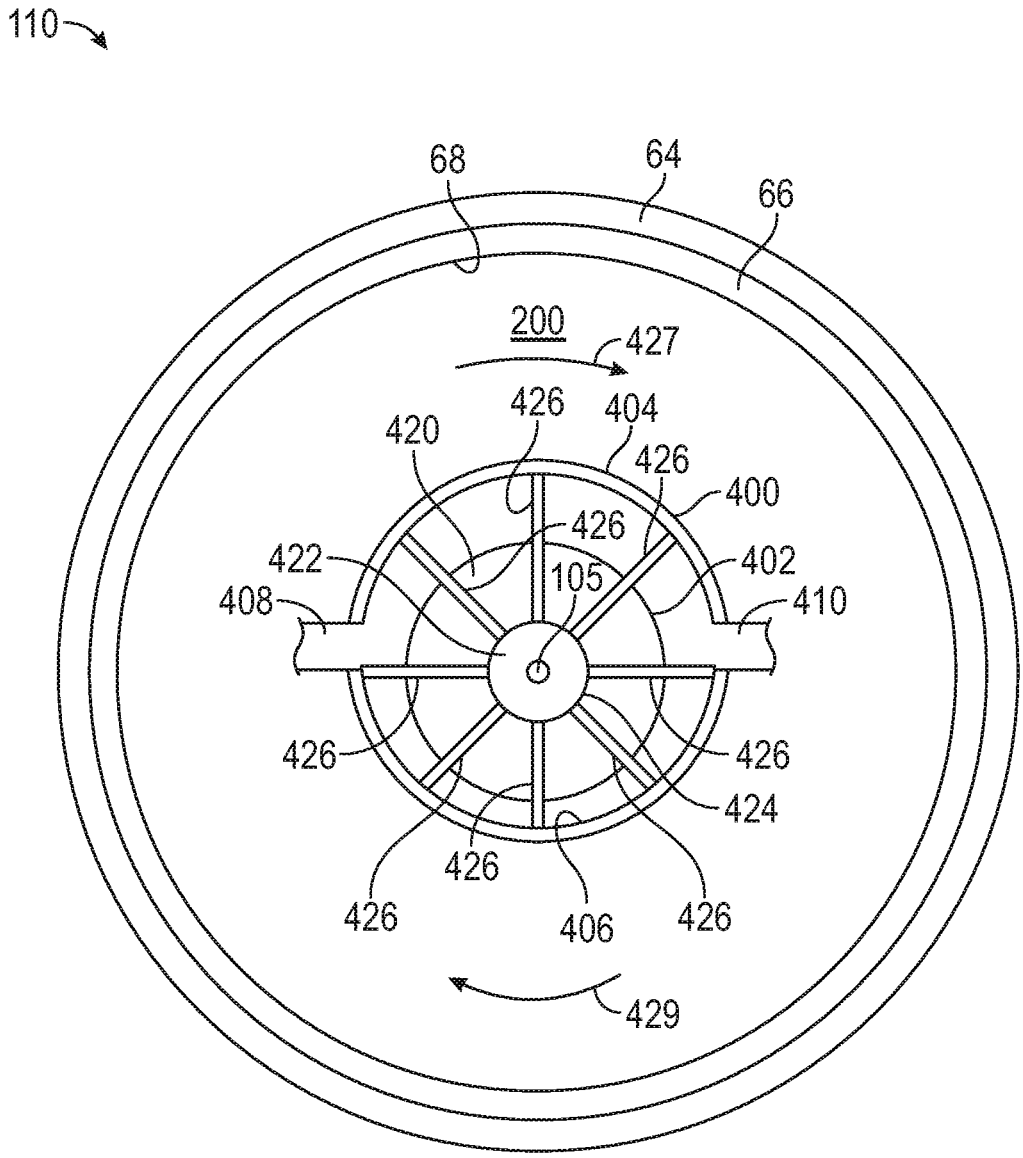
FIG. 15 is a schematic, top cross-sectional view of another embodiment of a torque application assembly of the wellhead assembly system of FIG. 2A in accordance with principles disclosed herein.

Referring to FIGS. 2 and 15, another embodiment of a torque application assembly 400 and a rotational or engagement member 420 are shown, where torque application assembly 400 and rotational member 420 are configured for use with tool 200 in lieu of, or in conjunction with, torque application assemblies 300, 320, 360, and rotational member 302, 340, 390, discussed above. In the embodiment shown, torque application assembly 400 generally includes a centrally disposed bore 402 extending axially through tool 200 and a sealed chamber 404 disposed about bore 402. Chamber 404 includes a generally cylindrical inner surface 406, a first or inlet port 408, and a second or outlet port 410, where ports 408 and 410 are in fluid communication with passage 210 shown in FIG. 3. In this embodiment, bore 402 is disposed coaxial with longitudinal axis 105, with chamber 404 disposed eccentrically or radially offset from longitudinal axis 105.

In the embodiment shown, rotational member 420 is generally cylindrical and includes a shaft 422 extending axially therefrom and through chamber 404, where shaft 422 includes a generally cylindrical outer surface 424. Rotational member 420 also includes a plurality of circumferentially spaced vanes 426 coupled with and extending radially outwards from the outer surface 424 of shaft 422, where a radially outer terminal end of each vane 426 engages inner surface 406 of chamber 404. Shaft 422 is longitudinally aligned with bore 402, and thus, radially offset from chamber 404. In this arrangement, each vane 426 includes a biasing member (not shown) configured to telescopically extend and retract the vane 426 as shaft 422 rotates within bore 402 such that the radially outer terminal end of the vane 426 remains in engagement with inner surface 406 of chamber 404.

In the configuration described above, torque application assembly 400 is configured to apply a torque and rotate rotational member 420 in response to pressurizing or receiving a fluid flow within inlet port 408. Particularly, pressurized fluid entering chamber 404 via inlet port 408 provides a pressure force against vanes 426. Given that shaft 422 is eccentrically disposed within radially offset chamber 404, and thus, the length of each vane 426 varies depending upon its position within chamber 404, a pressure differential is applied against shaft 422, applying a torque against vane 422 to rotate rotational member 420 in a first rotational direction 427 to set a tool of wellhead 50, such as packoff assembly 112 and/or hanger 100. Further, the flow of fluid through chamber 404 may be reversed by inletting a pressurized fluid into outlet port 410 to apply a torque against shaft 422 and rotate rotational member 420 in a second rotational direction 429. In certain embodiments, the control of fluid flow to ports 408 and 410 may be controlled via electrically actuated valves and ECM 502 in signal communication therewith.

Figure 16:
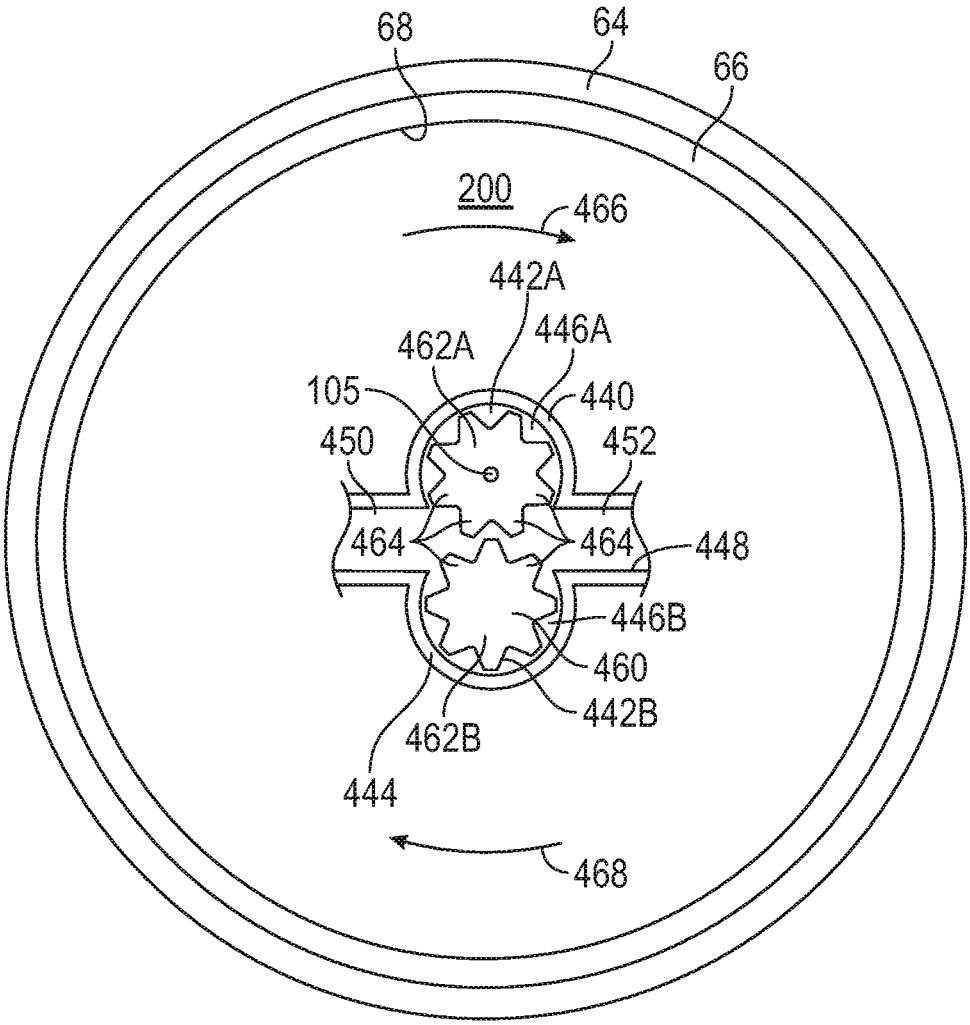
FIG. 16 is a schematic, top cross-sectional view of another embodiment of a torque application assembly of the wellhead assembly system of FIG. 2A in accordance with principles disclosed herein.

Referring to FIGS. 2 and 16, another embodiment of a torque application assembly 440 and a rotational or engagement member 460 are shown, where torque application assembly 440 and rotational member 460 are configured for use with tool 200 in lieu of, or in conjunction with, torque application assemblies 300, 320, 360, 400 and rotational member 302, 340, 390, 420 discussed above. In the embodiment shown, torque application assembly 440 generally includes a pair of adjacently disposed and radially offset bores 442*a* and 442*b* extending axially through tool 200, and a sealed chamber 444 disposed about bores 442*a* and 442*b*, where sealed chamber includes a first lobe 446*a* disposed about first bore 442*a* and a second lobe 446*b* disposed about second bore 442*b*. Chamber 446 includes an inner surface 448, a first or inlet port 450, and a second or outlet port 452, where ports 450 and 450 are in fluid communication with passage 210 shown in FIG. 3.

In the embodiment shown, rotational member 460 includes a pair of radially offset gears 462*a* and 462*b* extending axially therefrom and through chamber 444, where first or driven gear 462*a* is disposed in lobe 446*a* and second or idler gear 462*b* is disposed in lobe 446*b*, where driven gear 462*a* is disposed coaxially with longitudinal axis 105. Each gear 462*a* and 462*b* include a plurality of radially extending teeth 464 configured to engage the inner surface 448 of chamber 444 and mesh as gears 462*a* and 462*b* counter-rotate during operation. In this configuration, torque application assembly 440 is configured to apply a torque and rotate rotational member 460 in response to pressurizing or receiving a fluid flow within inlet port 450. Particularly, pressurized fluid entering chamber 404 via inlet port 450 provides a pressure force against the teeth 464 of driven gear 462*a*, and in turn, a torque for rotating driven gear 462*a* in a first rotational direction 466. As driven gear 462*a* rotates in response to the applied torque, idler gear 462*b* is driven in counter-rotation via the mesh between the mating teeth of 464 of gears 462*a* and 462*b*. In certain embodiments, driven gear 462*a* is coupled to a shaft or torque sleeve (not shown) for setting a tool of wellhead 50, such as packoff assembly 112. Further, the flow of fluid through chamber 444 may be reversed by inletting a pressurized fluid into outlet port 452 to apply a torque against driven gear 462*a* and rotate rotational member 460 in a second rotational direction 468. In certain embodiments, the control of fluid flow to ports 450 and 452 may be controlled via electrically actuated valves and ECM 502 in signal communication therewith.

Figure 17:
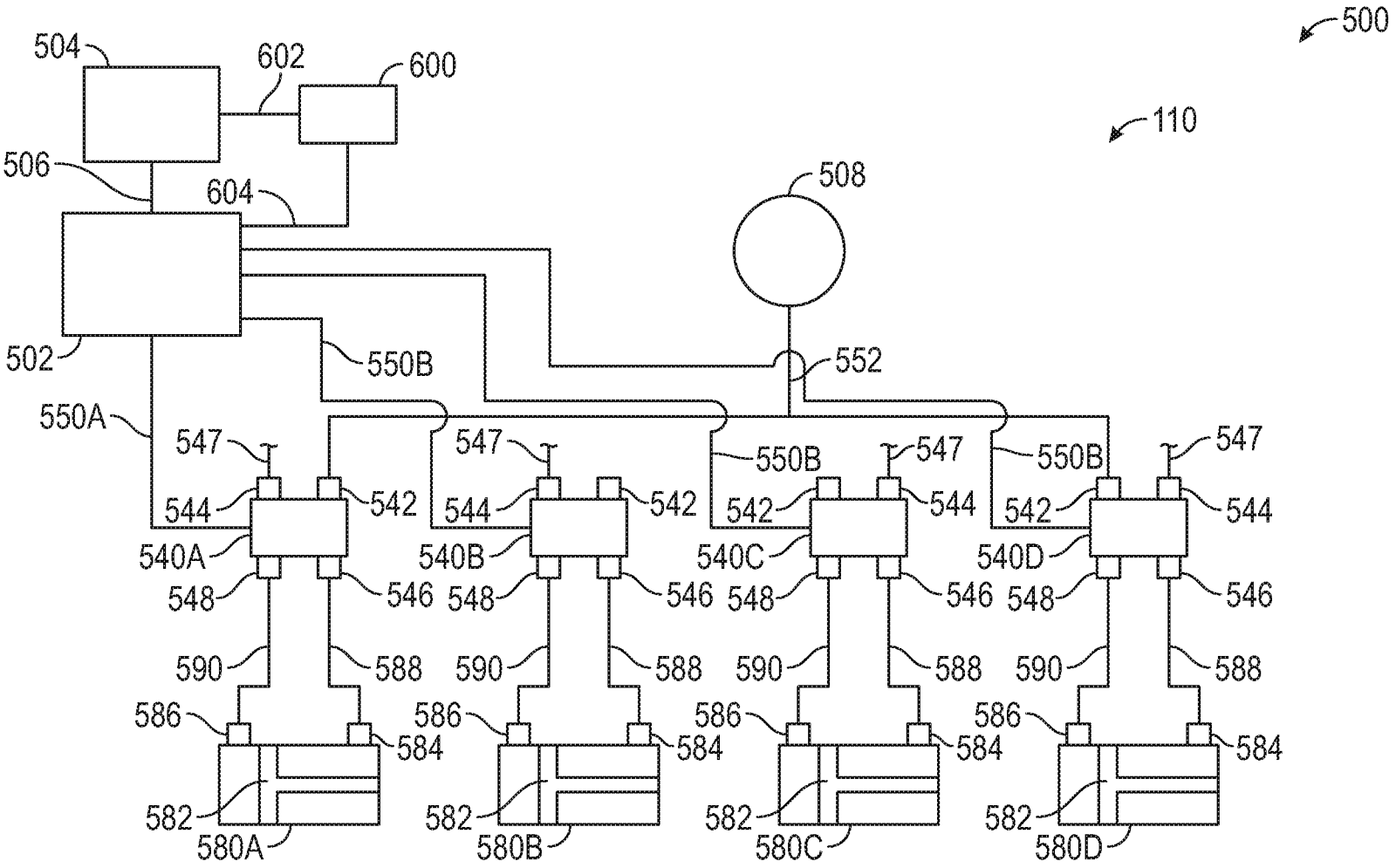
FIG. 17 is a schematic illustration of an actuation and control system of the wellhead assembly system of FIG. 2A in accordance with principles disclosed herein.

Referring to FIGS. 2 and 17, an embodiment of an actuation and control system 500 is shown schematically. Actuation and control system 500 is generally configured to electronically control actuators (e.g., hydraulic, electric, etc.) or actuatable components of wellhead assembly system 110, as well as to receive data from sensors of wellhead assembly system 110 for either transmission to a platform or rig of well system 10, where data outputted from the sensors as well as information relating to the position or operation of the electronically controlled actuators may be indicated to personnel of well system 10, or for use as part of an automated control system for installing components of wellhead 50, such as hanger 100 and packoff assembly 112. In the embodiment shown, system 500 generally includes ECM 502, a power supply 504, a fluid pressure supply or source 508, a plurality electrically actuated valves 540 (shown as 540*a*-540*d*), a plurality of hydraulically actuated components 580 (shown as 580*a*-580*d*), and an electrically actuated component 600. Valves 540 and hydraulically actuated components 580 may be disposed in or coupled to tool 200 or disposed in other components of wellhead 50.

In the embodiment shown, ECM 502 receives electrical power from power supply 504 via an electrical connection 506. In certain embodiments, power supply 504 comprises a battery or a hydraulically powered generator disposed in tool 200 or another component of wellhead 50, and electrical connection 506 comprises a wired connection or cable. In other embodiments, power supply 504 is disposed on the drilling platform (not shown) and comprises a battery, generator, or other device for providing electrical power to ECM 506. In this embodiment, connection 506 may comprise an electrical cable extending between tool 200 and the platform along string 22, or a wireless connection including wireless transmitters and receivers. In the embodiment shown, fluid pressure source 508 comprises fluid pressure or flow supplied by string 22, as shown in FIG. 3. In other embodiments, pressure source 508 may include one or more hydraulic accumulators coupled to wellhead 50 and in fluid communication with tool 200.

In this embodiment, electrically actuated valves 540 of system 500 each include a fluid inlet port 542, a fluid outlet port 544, a first actuation port 546, and a second actuation port 548. In this arrangement, each valve 540 is coupled and in signal communication with ECM 502 via an electrical connection 550 (shown as 550*a*-550*d*) extending therebetween. In certain embodiments, electrical connections 550 may include wired connections via one or more electrical cables or wireless connections including wireless transmitters and receivers. The fluid inlet port 542 of each valve 540 is in fluid communication with pressure source 508 via a pressure supply conduit 552 for supplying hydraulic pressure or flow to each valve 540 from pressure source 508. In certain embodiments, pressure supply conduit 552 includes passage 210 shown in FIG. 3. The fluid outlet port 544 is in fluid communication with a pressure release conduit 547, where pressure release conduit has a lower hydraulic pressure than pressure supply conduit 552. In certain embodiments, pressure release conduit 547 may vent to the surrounding environment, or may be in fluid communication with pressure source 508 to allow for the recirculation of fluid through system 500.

In the embodiment shown, each hydraulically actuated component 580 generally includes an actuator 582, a first port 584, and a second port 586. Although components 580 are illustrated in FIG. 17 as including a piston within a cylinder, components 580 need not include a piston and cylinder arrangement, and may include other components not shown in FIG. 17. The first port 584 of each actuator 580 is placed in fluid communication with the first actuation port 546 of its corresponding valve 540 (i.e., valve 540*a* with component 580*a*, valve 540*b* with component 580*b*, etc.) via a first fluid conduit 588 extending therebetween while the second port 586 of each actuator 580 is placed in fluid communication with the second actuation port 548 of its corresponding valve 540 via a second fluid conduit 590 extending therebetween. Also in the embodiment shown, electrically actuated component 600 is placed in electrical communication with power supply 504 via a power connection 602 extending therebetween, and is placed in signal communication with ECM 502 via an electrical connection 604 extending therebetween. Although system 500 of wellhead assembly system 110 is shown in FIG. 17 as including a single electrically actuated component 600 and four pairs of hydraulically actuated valves 540 and corresponding hydraulically actuated components 580, in other embodiments, system 500 and wellhead assembly system 110 may include varying numbers of components 600, valves 540, and components 580, depending upon the application. Further, while FIG. 17 illustrates each valve 540 corresponding with a single hydraulically actuated component 580, in other embodiments, a single valve 540 may control the actuation of multiple components 580. In other embodiments, a single hydraulically actuated component 580 may be controlled via a plurality of electrically controlled valves 540.

In this embodiment, each electrically controlled valve 540 includes a first or isolated position, a second or first actuation position, and third or a second actuation position. In the isolated position, first and second actuation ports 546 and 548 of the electrically controlled valve 540 are isolated from fluid inlet port 542 and fluid outlet port 544. In this position, fluid flow is restricted in fluid conduits 588 and 590, thereby fluidically sealing the corresponding hydraulically actuated component 580 (i.e., valve 540*a* and component 580*a*, etc.) from fluid inlet and outlet ports 542 and 544 of the valve 540. In the first actuation position, fluid inlet port 542 is placed into fluid communication with first actuation port 546 and fluid outlet port 544 is placed into fluid communication with second actuation port 548, thereby placing pressure supply conduit 552 into fluid communication with first fluid conduit 588 and second fluid conduit 590 into fluid communication with pressure release conduit 547. In this position, a pressure differential is created between first port 584 (pressurized) and second port 586 (depressurized).

In the second actuation position, fluid inlet port 542 is placed into fluid communication with second actuation port 548 and fluid outlet port 544 is placed into fluid communication with first actuation port 546, thereby placing pressure supply conduit 552 into fluid communication with second fluid conduit 590 and first fluid conduit 588 into fluid communication with pressure release conduit 547. In this position, a pressure differential is created between first port 584 (depressurized) and second port 586 (pressurized). In the embodiment shown, each electrically actuated valve 540 may be actuated or transitioned between the isolated, first actuation, and second actuation positions in response to a signal transmitted from ECM 502 via corresponding electrical connection 550 (i.e., valve 540*a* and connection 550*a*, etc.). In turn, the transmission of signals from ECM 502 to valves 540 may be controlled by personnel at the platform via a wireless or wired connection therebetween, or ECM 502 may automatically control the positioning of valves 540 as part of an automated control system.

In the embodiment shown, the actuator 582 of each hydraulically actuated component 580 includes a first position and a second position, and may be actuated between the first and second positions via the positioning of its corresponding electrically controlled valve 540 (i.e., valve 540*a* and component 580*a*, etc.). Particularly, when valve 540 is disposed in the isolated position, the actuator 582 of the corresponding component 580 is held in its current position (either first or second). When actuator 582 of component 580 is disposed in the first position, actuator 582 may be actuated into the second position by disposing valve 540 into the first actuation position, thereby creating a first pressure differential in actuator 582 to displace actuator 582 into the second position. Conversely, when actuator 582 of component 580 is disposed in the second position, actuator 582 may be actuated into the first position by disposing valve 540 into the second actuation position, thereby creating a second pressure differential in actuator 582 to displace actuator 582 into the first position. In the embodiment shown, electrically actuated component 600 comprises an electrical actuator that is configured to be actuated via power supply supplied by power supply 504 via power connection 602, where the actuation of component 600 is controlled by ECM 502 via electrical connection 604.

In this embodiment, hydraulically actuated components 580 and electrically actuated components 600 comprise components of wellhead 50 installed, set, energized, latched, or otherwise manipulated by tool 200 during assembly of wellhead 50, and their corresponding actuators for performing the installation, setting, energizing, latching, or other manipulation. For instance, in certain embodiments one or more of components 590 and 600 may comprise torque application assemblies 300, 320, 360, 400, 440 and rotational members 302, 340, 390, 420, and 460 discussed above, for setting hanger 100, packoff assembly 112, and other components of wellhead 50. In this manner, instead of running individual hydraulic control lines (subject to damage or failure during operation) from the drilling platform to the wellhead 50 for individually controlling each hydraulically actuated component of wellhead 50, each hydraulically actuated component of wellhead 50 may be actuated via the fluid pressure supplied by string 22. Reducing the number of or eliminating hydraulic control lines running from the drilling platform may also increase the safety of the well system 10 by reducing tripping hazards on the floor of the platform. Moreover, the electrical control of hydraulically actuated components 580 facilitated by valves 540 and ECM 502 reduces or eliminates the manual operation of components 580, thereby increasing the accuracy of force or torque supplied to components 580, and reducing the time required for actuating components 580 and installing wellhead 50. Moreover, ECM 502 also facilitates the use of landing sensors 120 and alignment sensors 240 discussed above in landing hanger 100, as well as other landed components of wellhead 50.

Figure 18:
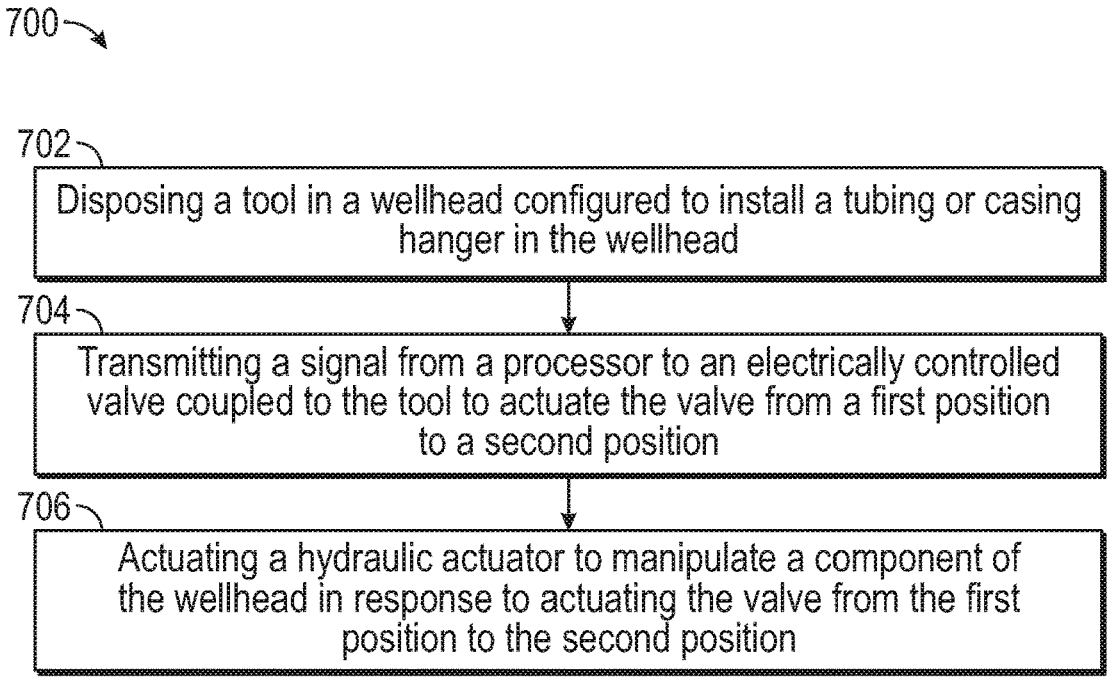
FIG. 18 is a flowchart illustrating a method for assembling a wellhead in accordance with principles disclosed herein.

Referring to FIG. 18, an embodiment of a method 700 for installing a wellhead is shown. Starting at block 702 of method 700, a tool configured to install a tubing or casing hanger in a wellhead is disposed in the wellhead. In certain embodiments, block 702 comprises disposing tool 200 (shown in FIGS. 2A and 2B), with hanger 100 and packoff assembly 112 coupled thereto, in the bore 66 of spool 64. In some embodiments, disposing tool 200 includes running tool 200 from a drilling platform to spool 64 via string 22, which extends between tool 200 and the platform. At block 704 of method 700, a signal from a processor is transmitted to an electrically controlled valve coupled to the tool to actuate the valve from a first position to a second position. In some embodiments, block 704 comprises transmitting a signal from ECM 502 (shown in FIGS. 2 and 17) to electrically controlled valve 540*a* to actuate valve 540*a* from the isolated position to the first actuation position, as discussed above. In this embodiment, actuating valve 540*a* into the first actuation position causes actuator 582 of hydraulically actuated component 580*a* to be actuated from the first position to the second position, also as discussed above.

At block 706 of method 700, a hydraulic actuator is actuated to manipulate a component of the wellhead in response to actuating the valve from the first position to the second position. In certain embodiments, block 706 comprises actuating the actuator 582 from the first position to the second position to rotate hanger 100 coupled to tool 200 and/or apply a torque to packoff assembly 112. In certain embodiments, rotating hanger 100 comprises actuating one or more of the torque application assemblies 300, 320, 360, 400, and 440 to rotate the rotational members 302, 340, 390, 420, and 460 discussed above.

Figure 19:
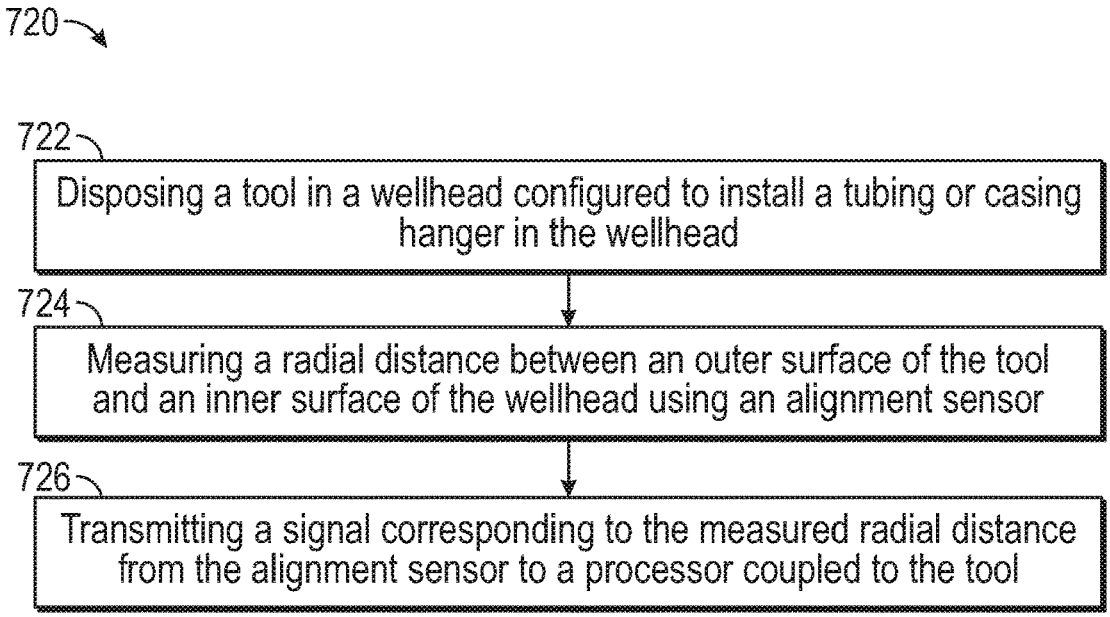
FIG. 19 is a flowchart illustrating another method for assembling a wellhead in accordance with principles disclosed herein.

Referring to FIG. 19, an embodiment of a method 720 for installing a wellhead is shown. Starting at block 722 of method 720, a tool configured to install a tubing or casing hanger in a wellhead is disposed in the wellhead. In some embodiments, block 722 comprises disposing tool 200 (shown in FIGS. 2A and 2B), with hanger 100 and packoff assembly 112 coupled thereto, in the bore 66 of spool 64. In some embodiments, disposing tool 200 includes running tool 200 from a drilling platform to spool 64 via string 22, which extends between tool 200 and the platform. At block 724 of method 720, a radial distance between an outer surface of the tool and an inner surface of the wellhead is measured using an alignment sensor. In certain embodiments, block 724 comprises measuring one or more radial clearances 254 (shown in FIG. 9) between the outer surface 201 of tool 200 and the inner surface 68 of spool 64 using one or more of a plurality of circumferentially spaced alignment sensors 240 disposed in either tool 200 (shown in FIG. 2A) or spool 64 (shown in FIG. 2B). At block 726 of method 720, a signal corresponding to the measured radial distance from the alignment sensor is transmitted to a processor coupled to the tool. In certain embodiments, block 726 comprises transmitting signals from alignment sensors 240 to ECM 502 (shown in FIGS. 2A and 2B), where each transmitted signal corresponds to a radial clearance 254 measured by the respective alignment sensor 240.

Figure 20:
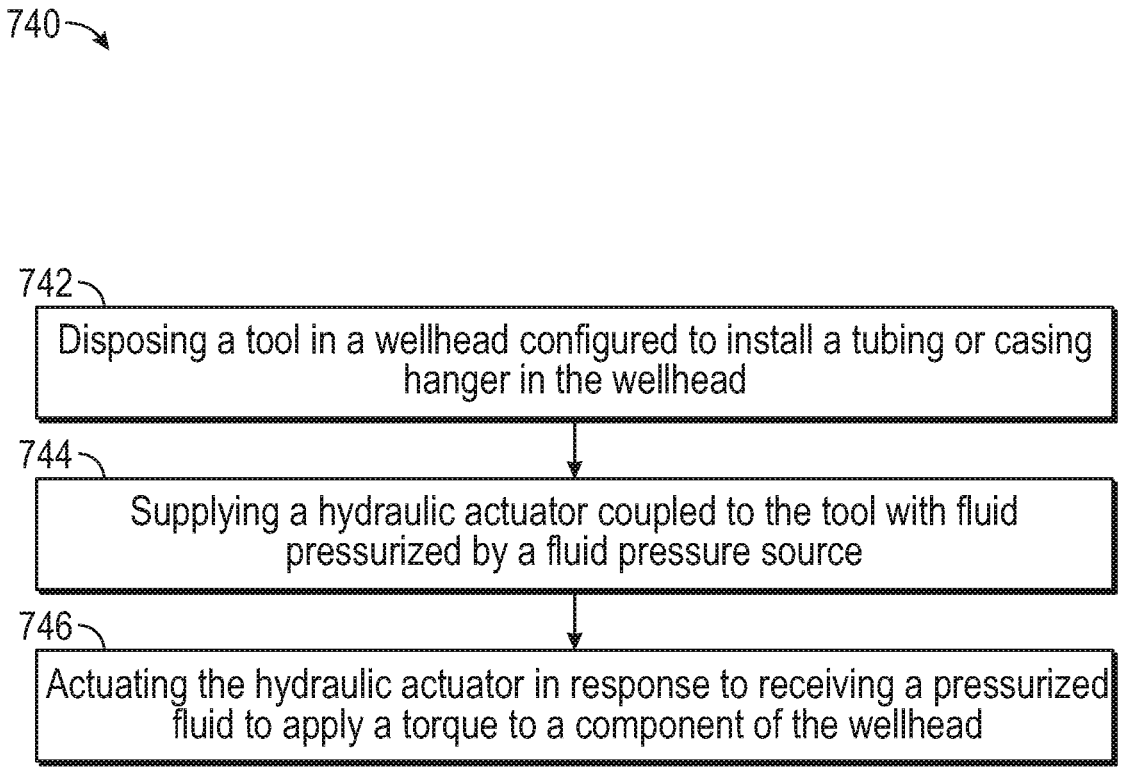
FIG. 20 is a flowchart illustrating another method for assembling a wellhead in accordance with principles disclosed herein.

Referring to FIG. 20, an embodiment of a method 740 for installing a wellhead is shown. Starting at block 742 of method 740, a tool configured to install a tubing or casing hanger in a wellhead is disposed in the wellhead. In some embodiments, block 742 comprises disposing tool 200 (shown in FIGS. 2A and 2B), with hanger 100 and packoff assembly 112 coupled thereto, in the bore 66 of spool 64. In some embodiments, disposing tool 200 includes running tool 200 from a drilling platform to spool 64 via string 22, which extends between tool 200 and the platform. At block 744 of method 740, a hydraulic actuator coupled to the tool is supplied with fluid pressurized by a fluid pressure source. In some embodiments, block 744 comprises supplying one or more of torque application assemblies 300, 320, 360, 400, and 440 described above with fluid pressure from passage 210 of pressure intensifier 202 (shown in FIG. 3), where the fluid disposed in passage 210 is pressurized by fluid disposed in bore 24 of string 22. At block 746 of method 740, a hydraulic actuator is actuated in response to receiving pressurized fluid to apply a torque to a component of the wellhead. In some embodiments, block 746 comprises applying a torque to hanger 100, packoff assembly 112, or other components of wellhead 50 using one or more of torque application assemblies 300, 320, 360, 400, and 440 described above. Although methods 700, 720, and 740 are shown and described separately, methods 700, 720, and 740, as well as individual features of each method, may be combined when performing a method of assembling a wellhead.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A wellhead system, comprising:

a tubing or casing hanger to be installed in a wellhead, the tubing or casing hanger comprising an outer surface including a landing profile configured to engage a mating landing profile of the wellhead;

a landing sensor configured to transmit a signal indicating contact between the landing profile of the tubing or casing hanger and the landing profile of the wellhead, wherein the landing sensor comprises a flexible switch biased into a position protruding from the outer surface of the tubing or casing hanger and wherein the landing sensor is configured to flex into contact with an electrical contact in response to the landing profile of the tubing or casing hanger contacting the landing profile of the wellhead; and a processor configured to receive the signal transmitted by the landing sensor.

2. The wellhead system of claim 1, wherein the landing sensor is disposed on the landing profile of the tubing or casing hanger.

3. The wellhead system of claim 1, further comprising a plurality of landing sensors disposed on the landing profile of the tubing or casing hanger, each landing sensor configured to transmit a signal indicating contact between the landing profile of the tubing or casing hanger and the landing profile of the wellhead.

4. The wellhead system of claim 3, wherein, in response to only a portion of the landing sensors transmitting signals indicating contact between the landing profile of the tubing or casing hanger and the landing profile of the wellhead, the processor is configured to transmit a signal indicating an angular misalignment between a longitudinal axis of the tubing or casing hanger and a longitudinal axis of the wellhead.

5. The wellhead system of claim 1, further comprising:

a plurality of alignment sensors circumferentially spaced about an outer surface of a tool coupled to the tubing or casing hanger, the tool configured to install the tubing or casing hanger in the wellhead;

wherein each alignment sensor is configured to transmit a signal indicating a distance between the outer surface of the tool and an inner surface of the wellhead;

wherein the processor is configured to receive the signals transmitted by the plurality of alignment sensors.

6. A wellhead system, comprising:

a tool configured to install a tubing or casing hanger in a wellhead;

a plurality of alignment sensors circumferentially spaced about an outer surface of the tool, wherein each alignment sensor is configured to transmit a signal indicating a distance between the outer surface of the tool and an inner surface of the wellhead; and a processor coupled to the tool and in signal communication with the plurality of alignment sensors, the processor configured to receive the signals transmitted by the plurality of alignment sensor;

wherein, in response to one of the plurality of alignment sensors transmitting a signal indicating a first distance between the outer surface of the tool and the inner surface of the wellhead and another one of the plurality of alignment sensors transmitting a signal indicating a second distance between the outer surface of the tool and the inner surface of the wellhead, where the first distance is different than the second distance, the processor is configured to transmit a signal indicating a radial misalignment between a longitudinal axis of the tubing or casing hanger and a longitudinal axis of the wellhead.

7. The wellhead system of claim 6, wherein each of the plurality of alignment sensors are disposed on an outer surface of the tool.

8. The wellhead system of claim 6, wherein each of the plurality of alignment sensors are disposed on an inner surface of the wellhead.

9. The wellhead system of claim 6, wherein each of the plurality of alignment sensors comprises:

a contactor biased away from the outer surface of the tool by a first biasing member; and a sensor pin biased into engagement with the contactor by a second biasing member, the sensor pin at least partially disposed in a linear variable differential transformer;

wherein the linear variable differential transformer is configured to transmit a signal indicating the position of the sensor pin within the linear variable differential transformer.

10. The wellhead system of claim 6, wherein each of the plurality of alignment sensors comprises a proximity sensor.

11. The wellhead system of claim 6, further comprising a plurality of landing sensors disposed on a landing profile of the tubing or casing hanger, each landing sensor configured to transmit a signal indicating contact between the landing profile of the tubing or casing hanger and a landing profile of the wellhead.

12. A method of assembling a wellhead, comprising:

disposing a tool in the wellhead, the tool configured to install a tubing or casing hanger in the wellhead;

measuring a radial distance between an outer surface of the tool and an inner surface of the wellhead using an alignment sensor;

transmitting a signal corresponding to the measured radial distance from the alignment sensor to a processor coupled to the tool;

transmitting a signal indicating contact between a landing profile of the tubing or casing higher and a landing profile of the wellhead to the processor using a landing sensor; and transmitting a signal from the processor indicating an angular misalignment between a longitudinal axis of the tubing or casing hanger and a longitudinal axis of the wellhead.

13. The method of claim 12, further comprising:

measuring a plurality of radial distances between the outer surface of the tool and the inner surface of the wellhead using a plurality of alignment sensors spaced circumferentially about the tool; and transmitting a plurality of signals corresponding to the measured radial distances from the alignment sensors to the processor.

14. The method of claim 13, further comprising transmitting a signal from the processor indicating a radial misalignment between a longitudinal axis of the tubing or casing hanger and a longitudinal axis of the wellhead.

* * * * *